US012227959B1

(12) United States Patent
Nichols et al.

(10) Patent No.: US 12,227,959 B1
(45) Date of Patent: Feb. 18, 2025

(54) CABLE-REINFORCED BARRIER

(71) Applicant: Ameristar Perimeter Security USA Inc., Tulsa, OK (US)

(72) Inventors: Robert W Nichols, Owasso, OK (US); Michael D Elmore, Broken Arrow, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 179 days.

(21) Appl. No.: 17/570,078

(22) Filed: Jan. 6, 2022

Related U.S. Application Data

(60) Provisional application No. 63/279,200, filed on Nov. 15, 2021.

(51) Int. Cl.
*E04H 17/14* (2006.01)
*E04H 17/10* (2006.01)
*E04H 17/20* (2006.01)

(52) U.S. Cl.
CPC ..... *E04H 17/1488* (2021.01); *E04H 17/124* (2021.01); *E04H 17/21* (2021.01)

(58) Field of Classification Search
CPC . E01F 15/02506; E01F 15/065; E01F 15/025; E01F 15/06; E04H 17/02;
(Continued)

(56) References Cited

U.S. PATENT DOCUMENTS 388,840 A * 9/1888 Crosby ..... F16G 11/06 24/135 R
2,772,846 A 12/1956 Skar
(Continued)

FOREIGN PATENT DOCUMENTS

EP 1832681 A1 * 9/2007 ..... E01F 15/025
KR 20090087215 A * 2/2008 ..... E01F 15/025
WO WO-2005040499 A1 * 5/2005 ..... E01F 15/06

OTHER PUBLICATIONS

Ameristar Perimeter Security USA Inc., Stalwart K-8 Post and Rail, published in the United States by at least Oct. 22, 2020.
(Continued)

*Primary Examiner* — Amber R Anderson
*Assistant Examiner* — Kevin J Baynes
(74) *Attorney, Agent, or Firm* — Gary Peterson

(57) ABSTRACT

A barrier is formed from bollards and posts that are embedded in a terrain. The bollards and posts are interconnected by, and support, vertically-spaced runs of primary rails. The rails in each run are aligned in end-to-end relationship. A strengthening cable extends within each run, and is anchored at each end within a concrete-filled bollard. Each bollard contains an elongate, vertically-oriented cable entry port that can receive the end portions of all of the cables in the runs, disposed in laterally-spaced relationship. A two-part closure covers the cable entry port, and includes spaced cable openings that maintain the cables that exit the bollard at a desired lateral separation distance. A cable confinement bracket installed at each post prevents the cables from flying out of the primary rails after an impact. The bracket features a spine that restrains the cables, which pass through bays notched in the spine's lower edge. Each cable may be formed from structural strand, and may include attached cable clips to enhance the cable's resistance to pullout from the bollards.

28 Claims, 27 Drawing Sheets

(58) Field of Classification Search
CPC ..... E04H 17/04; E04H 17/055; E04H 17/06; E04H 17/10; E04H 17/12; E04H 17/124; E04H 17/1488; E04H 17/21
USPC ..... D25/38.1, 39, 131
See application file for complete search history.

(56) References Cited

U.S. PATENT DOCUMENTS

| | | | | |
|---|---|---|---|---|
| D197,326 | S | 1/1964 | Morrison | |
| 4,075,473 | A * | 2/1978 | Winston | E01F 15/025 404/6 |
| D285,047 | S | 8/1986 | Dean et al. | |
| D286,495 | S | 11/1986 | Blomdahl | |
| 4,690,359 | A | 9/1987 | Phillips | |
| D298,501 | S | 11/1988 | March | |
| D309,560 | S | 7/1990 | Warlick | |
| 5,275,382 | A * | 1/1994 | Charbaut | E04H 17/20 256/48 |
| 5,425,520 | A | 6/1995 | Masumoto | |
| D368,218 | S | 3/1996 | Klein, III | |
| 5,655,740 | A | 8/1997 | Lazarus | |
| D399,125 | S | 10/1998 | Blanchard | |
| D404,989 | S | 2/1999 | Sykes | |
| 6,038,399 | A * | 3/2000 | Fisher | H04L 9/40 713/1 |
| D446,710 | S | 8/2001 | Sterling et al. | |
| D495,588 | S | 9/2004 | Wurdack | |
| 6,874,767 | B1 | 4/2005 | Gibbs | |
| 6,962,328 | B2 * | 11/2005 | Bergendahl | E01F 15/06 404/6 |
| 7,188,826 | B1 | 3/2007 | Gibbs | |
| 7,249,908 | B2 * | 7/2007 | Bergendahl | E01F 15/025 404/6 |
| D555,466 | S | 11/2007 | Hennig | |
| D572,374 | S | 7/2008 | Gibbs | |
| 7,441,751 | B1 | 10/2008 | Gibbs | |
| D599,193 | S | 9/2009 | Meyer et al. | |
| D626,817 | S | 11/2010 | Donowho et al. | |
| 7,866,635 | B2 * | 1/2011 | Payne | E04H 17/168 256/24 |
| 7,988,133 | B2 * | 8/2011 | Gripne | E01F 15/025 256/13.1 |
| D653,524 | S | 2/2012 | Meyer | |
| 8,210,504 | B1 * | 7/2012 | Skornickel | E04H 17/1417 256/65.01 |
| 8,382,070 | B1 | 2/2013 | Gibbs | |
| D679,172 | S | 4/2013 | Dixon | |
| 8,973,903 | B2 * | 3/2015 | Akerstrom | E01F 15/06 256/13.1 |
| 8,992,116 | B2 * | 3/2015 | Sloan | E04H 17/127 404/6 |
| 9,428,872 | B2 * | 8/2016 | Neusch | E01F 13/12 |
| D777,014 | S | 1/2017 | Wolfer | |
| 9,719,220 | B2 * | 8/2017 | Neusch | E01F 13/12 |
| D830,153 | S | 10/2018 | Sadofsky | |
| D883,775 | S | 5/2020 | Wojcik et al. | |
| D884,459 | S | 5/2020 | Pung | |
| D979,387 | S | 2/2023 | Axelsson | |
| 2005/0036832 | A1 | 2/2005 | Smith et al. | |
| 2009/0003932 | A1 | 1/2009 | Neusch | |
| 2009/0321699 | A1 * | 12/2009 | Payne | E01F 15/06 29/428 |
| 2011/0062100 | A1 | 3/2011 | Webb et al. | |
| 2020/0305596 | A1 | 10/2020 | Min | |
| 2021/0115635 | A1 * | 4/2021 | Delot | E01F 15/06 |

OTHER PUBLICATIONS

Ameristar Perimeter Security USA Inc., Stalwart M30 P1 Post and Rail, published in the United States by at least Oct. 22, 2020.
Ameristar Perimeter Security USA Inc., Stalwart M30 P2 Post and Rail, published in the United States by at least Oct. 22, 2020.
Ameristar Perimeter Security USA Inc., Stalwart M50-P1 Single Run Layout, published in the United States by at least Oct. 22, 2020.
Ameristar Perimeter Security USA Inc., Stalwart PU50 P2 Single Run Layout, published in the United States by at least Oct. 22, 2020.
Ameristar Perimeter Security USA Inc., Stalwart PU60 P2 Single Run Layout, published in the United States by at least Oct. 22, 2020.
Ameristar Perimeter Security USA Inc., Stalwart flyer #9811, published in the United States by at least Jun. 30, 2020.
Ameristar Perimeter Security USA Inc., Stalwart IS flyer #9807, published in the United States by at least Jun. 30, 2020.
Ameristar Perimeter Security USA Inc., Stalwart Optima catalog, published in the United States by at least May 15, 2019.

* cited by examiner

CABLE-REINFORCED BARRIER

SUMMARY OF THE INVENTION

A kit is formed from a plurality of elongate cables and a plurality of elongate and hollow bollards. Each bollard has a longitudinal axis, a pair of opposed ends and an elongate axially-extending cable entry port formed intermediate those ends. The cable entry port is sized to receive the end portions of the plurality of cables therethrough while the cables are in a laterally-offset relationship.

A kit is formed from a plurality of elongate and hollow bollards, a plurality of elongate cables and a plurality of multi-part closures. Each bollard has a pair of opposed ends and a cable entry port disposed intermediate those ends. Each closure is sized to fully cover the cable entry port and has a plurality of cable openings formed therein. Each cable opening is sized to clearingly receive one of the cables therethrough. Each closure is broken into parts at an internal edge that intersects each of the cable openings.

A bracket is formed from a flat and elongate spine and a plurality of longitudinally-spaced feet. The spine has an upper edge and a lower edge. The lower edge includes a plurality of longitudinally-spaced rectilinear segments, and a plurality of longitudinally-spaced bays interspersed between those segments. The feet join the lower edge of the spine at the segments, and extend in orthogonal relationship to the spine.

A kit is formed from a plurality of elongate and hollow bollards, a plurality of elongate cables and a plurality of cable clips. Each bollard has a longitudinal axis, a pair of opposed ends and an elongate axially-extending cable entry port formed intermediate those ends. Each cable is formed from structural strand. Each cable clip is attachable to an end portion of one of the cables. The cable entry port of each bollard is sized to receive the end portions of at least one of the plurality of cables therethrough, while that end portion carries at least one attached cable clip.

BRIEF DESCRIPTION OF THE DRAWINGS

FIG. 6 is a side elevation view of the bollard shown in FIG. 5.

FIG. 19 is a front elevation view of an assembled closure.

FIG. 28 is a side elevation view of the cable confinement bracket shown in FIG. 27, taken along line 28-28.

FIG. 32 is a top plan view of a portion of the barrier shown in FIGS. 1 and 2, showing the relative positioning of a bollard and two posts.

FIG. 36 a side elevational view of a portion of the bollard of FIG. 6, showing barrier assembly at a stage subsequent to that shown in FIG. 35. The second piece of the closure has been installed on the bollard shown in FIG. 35.

FIG. 38 a enlarged side elevational view of a portion of the bollard of FIG. 6, showing barrier assembly at a stage subsequent to that shown in FIG. 36. Gaskets and rail attachment brackets have been installed on the bollard, and primary rails attached to rail attachment brackets. A cable has been inserted into each primary rail. A panel attachment bracket has been installed on the bollard.

FIG. 39 is a rear elevation view of the post of FIG. 10, showing barrier assembly at a stage subsequent to that shown in FIG. 33. Primary rails have been installed on both sides of the post plate, and cables positioned within the rails. A cable confinement bracket has been installed on the post plate.

DETAILED DESCRIPTION

Figure 1:
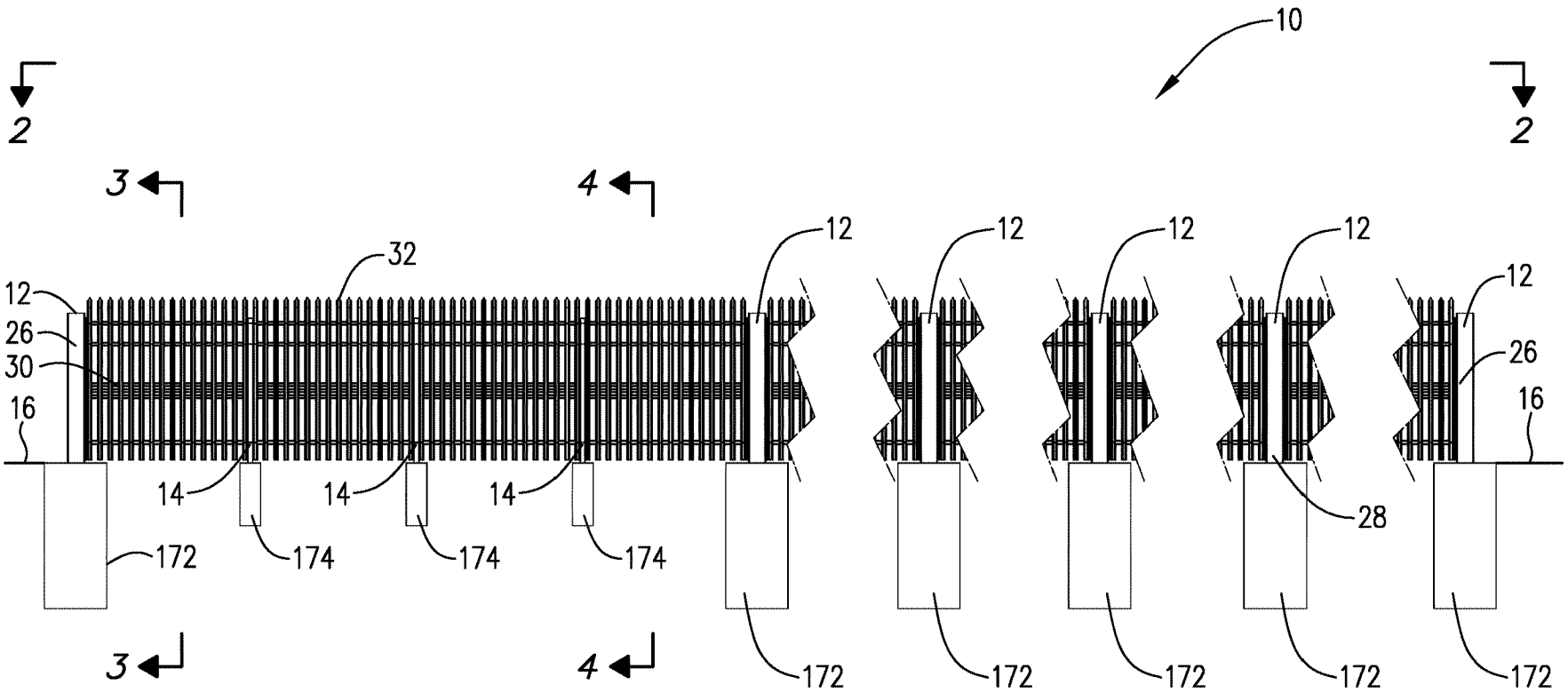
FIG. 1 is a front elevation view of a barrier situated on a terrain.
Figure 2:
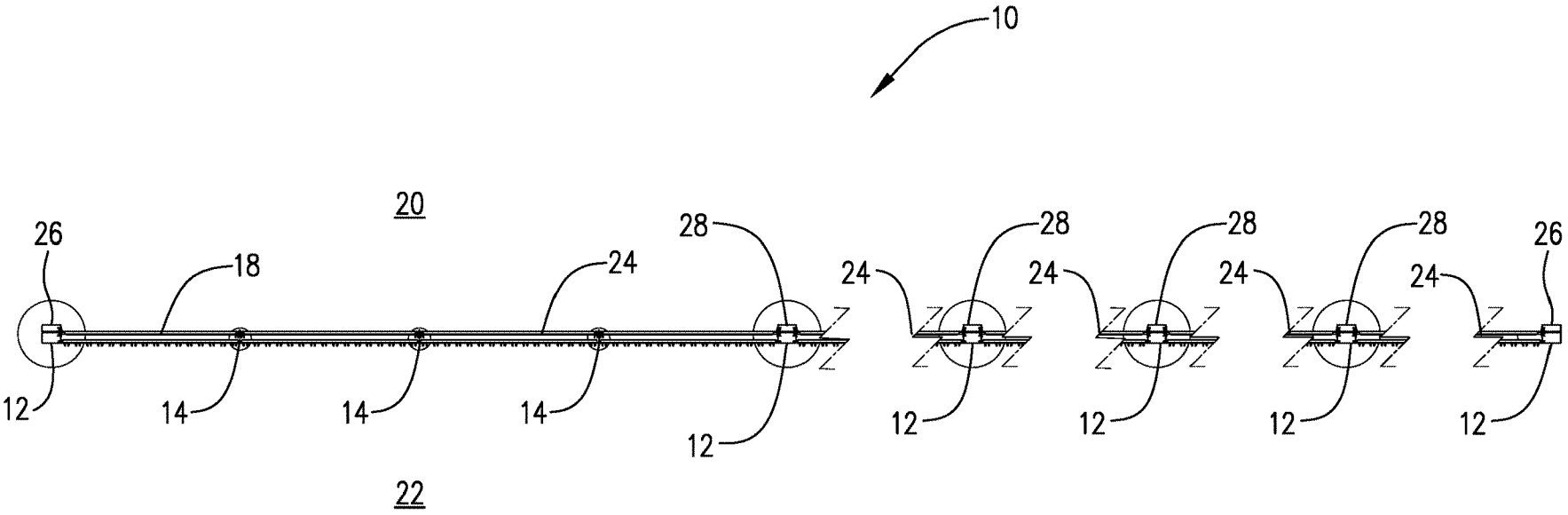
FIG. 2 is a top plan view of the barrier shown in FIG. 1, taken along line 2-2.

A barrier 10 is formed from a plurality of bollards 12 and a plurality of posts 14 situated on a terrain 16, preferably outdoors, as shown in FIGS. 1 and 2. The bollards 12 and posts 14 are embedded in the terrain 16, and form a lineal spine 18 that separates a protected zone 20 from an unprotected zone 22. The protected zone 20 may contain one or more individuals, properties or other assets that the barrier 10 is to protect.

Preferably, the barrier 10 is formed in sections 24, with each section 24 bounded by a pair of end bollards 26. Line bollards 28 and posts 14 are arranged between the end bollards 26. Adjoining sections 24 may share the same end bollard 26.

Figure 3:
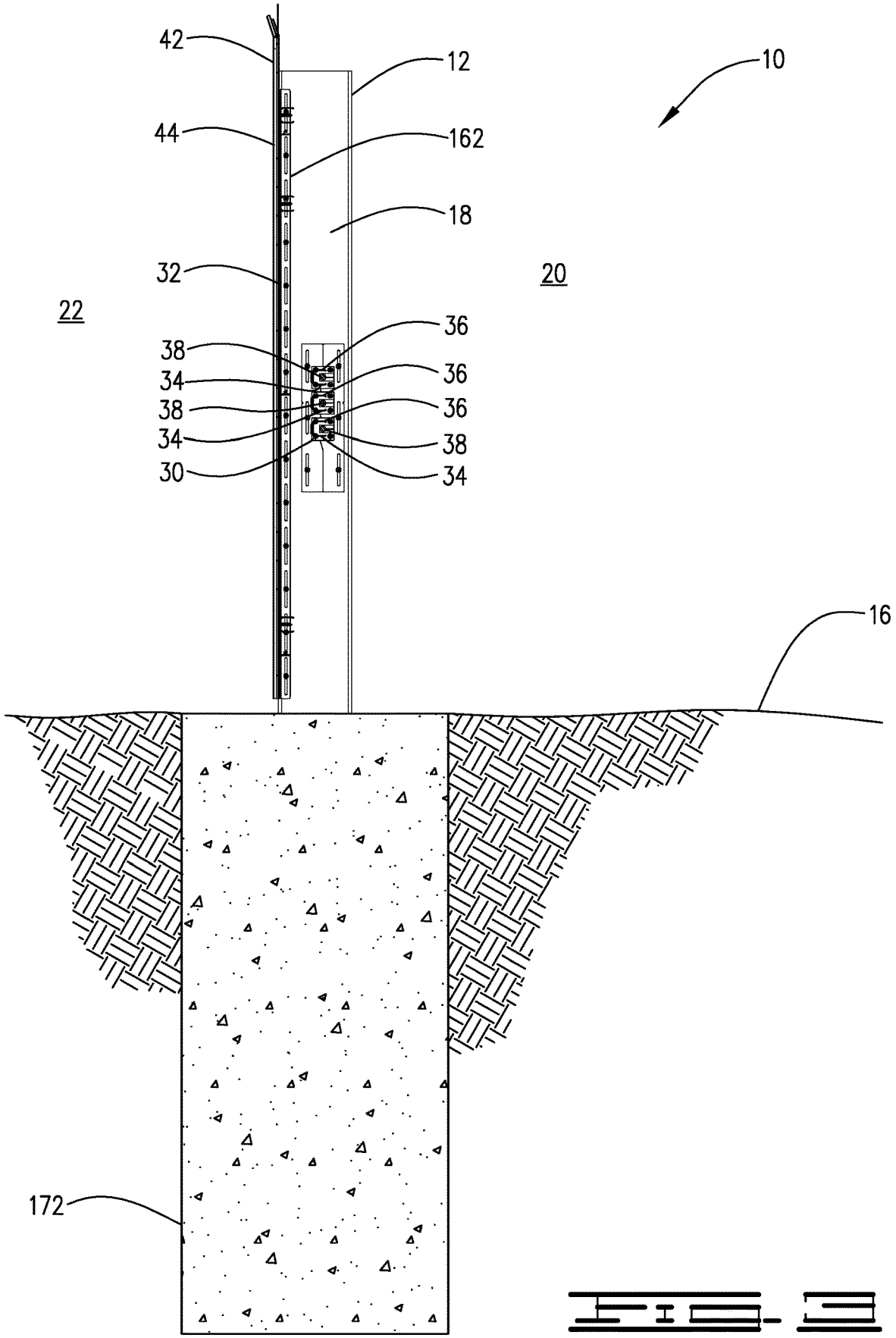
FIG. 3 is a side cross-sectional view of the barrier shown in FIG. 1, taken along line 3-3.
Figure 4:
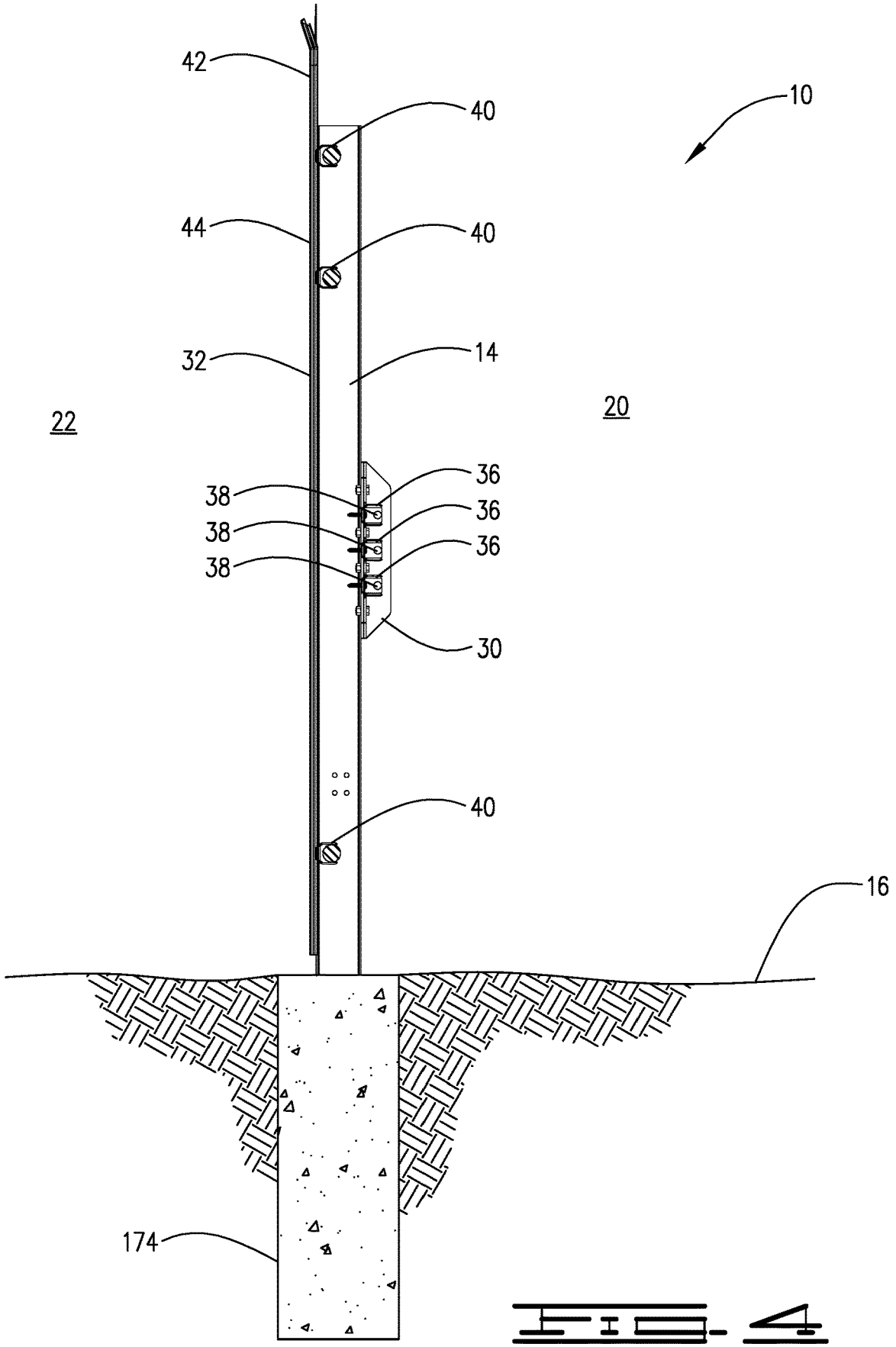
FIG. 4 is a side cross-sectional view of the barrier shown in FIG. 1, taken along line 4-4.

As shown in FIGS. 3 and 4, the barrier 10 includes a primary structure 30, situated nearest the protected zone 20, and a secondary structure 32, situated nearest the unprotected zone 22. Both the primary and secondary structures 30 and 32 are supported by the spine 18. The primary structure 30 protects the zone 20 from such threats as vehicular intrusion and impact, while the secondary structure 32 protects the zone 20 from more traditional threats, such as footbound intruders.

The primary structure 30 is formed from one or more runs 34 of a plurality of primary rails 36. The primary rails 36 are channel-shaped, and arranged in end-to-end relationship. A strengthening cable 38, shown in FIG. 16, extends within each run 34, and is anchored within a bollard 12 at each end.

The secondary structure 32 is formed from a plurality of secondary rails 40 and a plurality of pickets 42. The secondary rails 40, which also are channel-shaped, are assembled with the pickets 42 to form a plurality of framework panels 44. One such panel 44 is supported between each adjacent pair of posts 14, and between each bollard 12 and its adjacent post 14.

Figure 5:
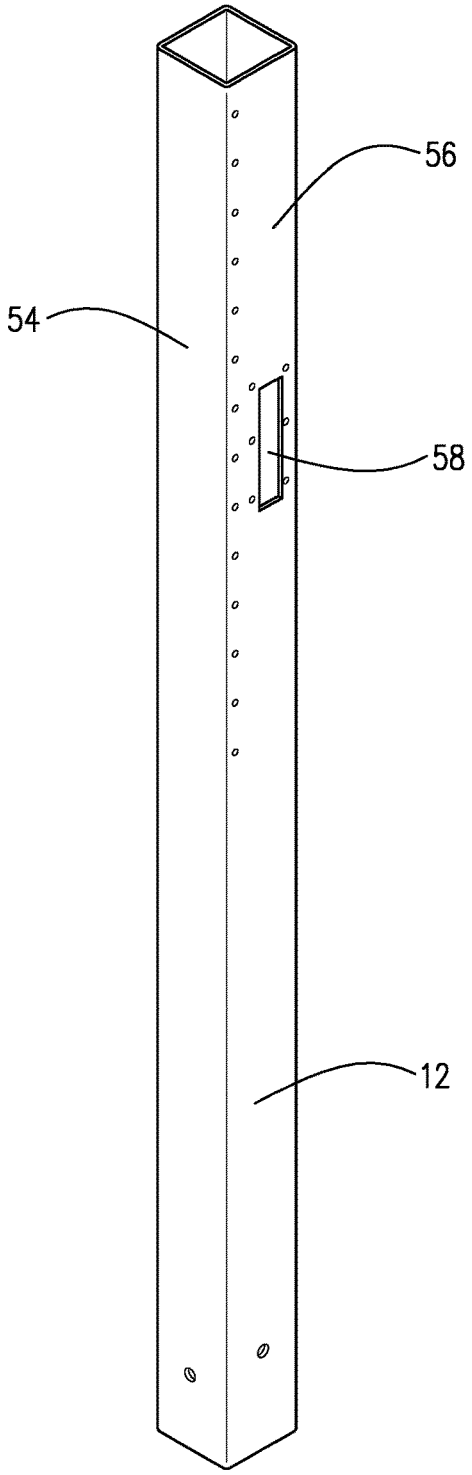
FIG. 5 is a perspective view of a bollard.
Figure 5:
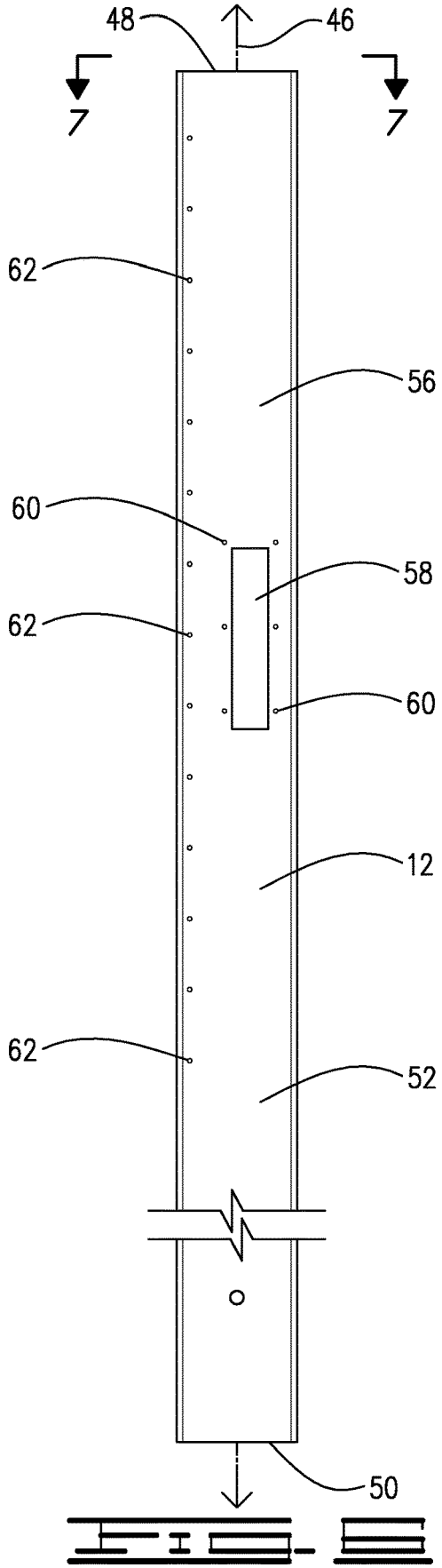
Figure 7:
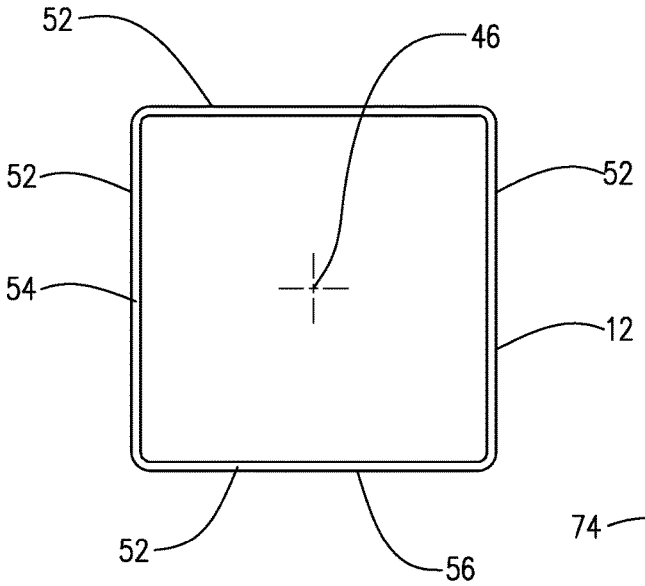
FIG. 7 is a top plan view of the bollard shown in FIG. 6, taken along line 7-7.

The bollard 12, shown in detail in FIGS. 5-7, is an elongate and hollow tubular member having a longitudinal axis 46 and opposed upper and lower ends 48 and 50. One or both of the ends 48 and 50 may be open to the bollard interior during assembly of the barrier 10, but each end is preferably closed with a cap or closure by at least the time that assembly is complete.

The bollard 12 has a uniform cross-sectional shape along its length. Preferably, that cross-sectional shape is polygonal, more preferably rectangular and most preferably square. When the cross-sectional shape of the bollard 12 is rectangular, the bollard 12 is characterized by two pairs of spaced, parallel and opposed sides 52. The sides 52 include at least one front side 54 and at least one cable entry side 56.

Each cable entry side 56 is provided with an elongate axially-extending cable entry port 58 situated intermediate the ends 48 and 50. Preferably, the cable entry port 58 is slot-like, and situated nearest to the upper end 48. The shape of the cable entry port 58 is preferably a non-square rectangle having major sides that extend parallel to the longitudinal axis 46. The cable entry port 58 is preferably situated in laterally offset relationship to the longitudinal centerline of the cable entry side 56.

Each cable entry port 58 is preferably sized to receive the end portions of a plurality of cables 38, while those end portions are in a laterally-offset relationship. More preferably, the plurality of cables 38 have a number equaling the number of cables 38 included in a section 24 of the barrier 10.

When a bollard 12 is to serve as an end bollard 26 for the barrier 10, preferably that bollard 12 has only a single cable entry side 56. When a bollard 12 is not to serve as an end bollard 26, it preferably has two cable entry sides 56, with a single cable entry port 58 being formed in each of two sides 56. When a bollard 12 with two cable entry sides 56 is to serve as a line bollard 28, the cable entry sides 56 are spaced, parallel, and opposed. The cable entry ports 58 in the two sides 56 are aligned.

When a bollard 12 with two cable entry sides 56 is to serve as a corner bollard, the cable entry sides 56 are adjacent. For a bollard 12 that will serve as an outside corner of the barrier 10, the sides 56 join at the inside corner of that bollard 12. For a bollard 12 that will serve as an inside corner of the barrier 10, the sides 56 join at the outside corner of that bollard 12. In either case, the cable entry ports 58 are located to be nearest the protected zone 20 when the bollard 12 is installed.

In all bollards 12 having two cable entry sides 56, those cable entry sides 56 are mirror images of one another.

Each cable entry side 56 is provided with a plurality of closure attachment openings 60 arrayed around the cable entry port 58. The closure attachment openings 60 are preferably identically sized and shaped. Each cable entry side 56 is also provided with a plurality of longitudinally-spaced panel attachment openings 62 that extend along the edge that joins the front side 54. The panel attachment openings 62 preferably extend rectilinearly, with uniform spacing, and are situated nearest the upper end 48. The panel attachment openings 62 are preferably identically sized and shaped.

Each front side 54 of the bollard 12 is a substantially solid structure with no cable entry port formed in it. A bollard 12 may have one or two front sides 54. In the case of a corner bollard, the bollard 12 will have front sides 54 that adjoin one another. Other types of bollards 12 will have a single front side 54 that adjoins either or both of the cable entry sides 56 of that bollard 12.

Apart from ports and openings possibly formed in the cable entry sides 56 as described above, the bollards 12 forming the barrier 10 are preferably of identical size, shape and construction.

In one embodiment, the bollard 12 has a length of 171 inches and the cross-sectional shape of a square with sides of 10 inches. The cable entry port 58 has a rectangular shape with a major side of 15 inches and a minor side of 3 inches. The upper end of the cable entry port 58 is situated 39.5 inches from the upper end 48. The panel attachment openings 62 extend for 81.94 inches from the upper end 48 and have a 5.88-inch separation.

Figure 8:
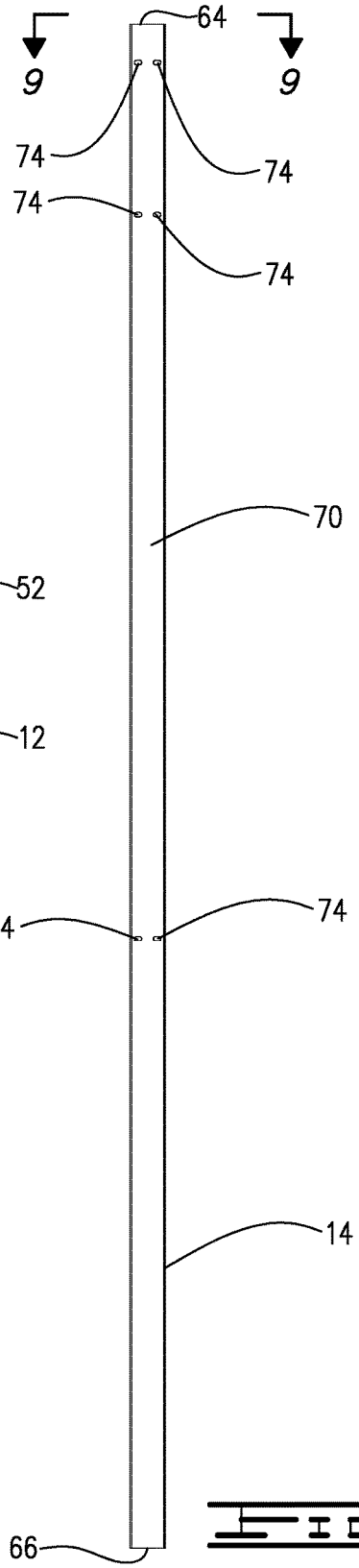
FIG. 8 is a front elevation view of a post.
Figure 9:
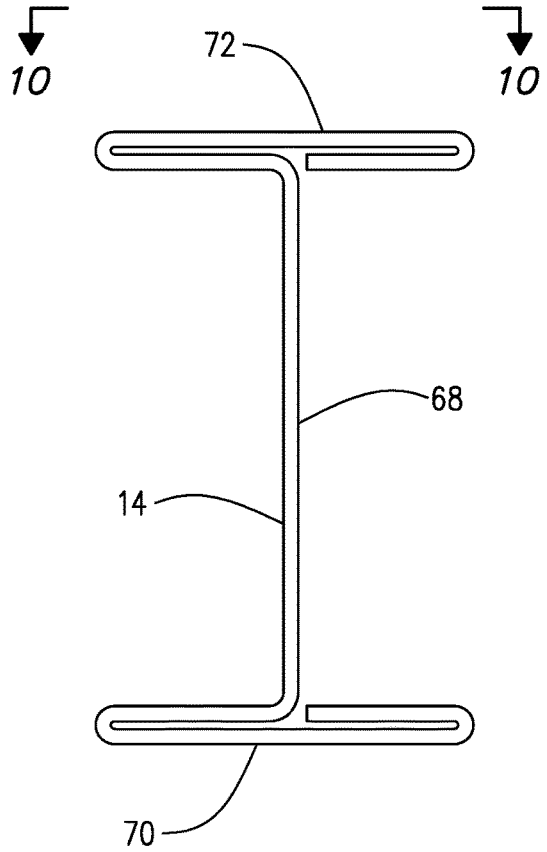
FIG. 9 is a top plan view of the post shown in FIG. 8, taken along line 9-9.
Figure 10:
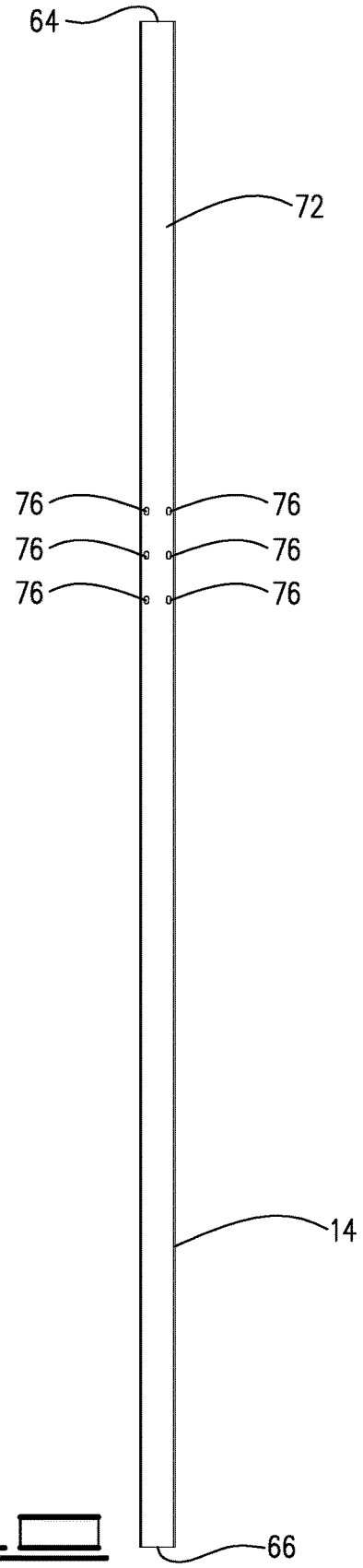
FIG. 10 is a rear elevation view of the post shown in FIG. 9, taken along line 10-10.
Figure 11:
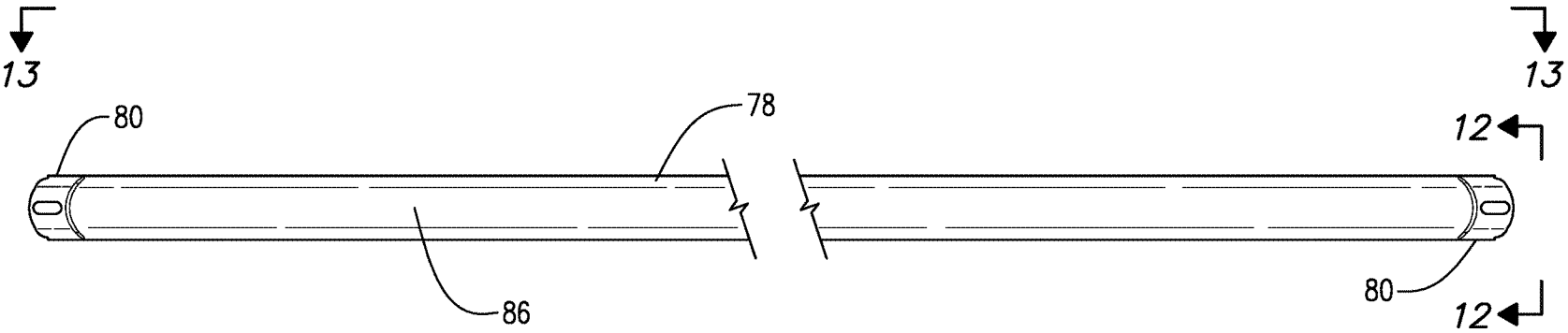
FIG. 11 is a front elevation view of a rail.
Figure 12:
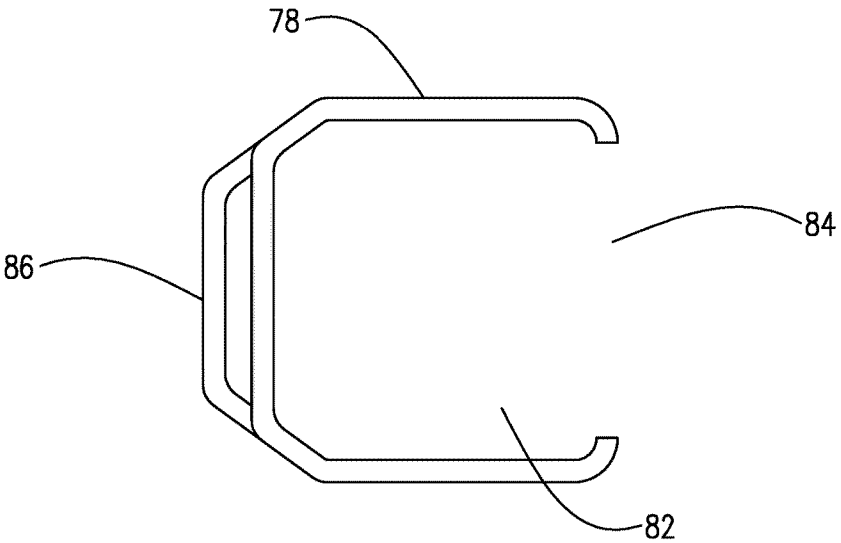
FIG. 12 is a side elevation view of the rail shown in FIG. 11, taken along line 12-12.
Figure 13:
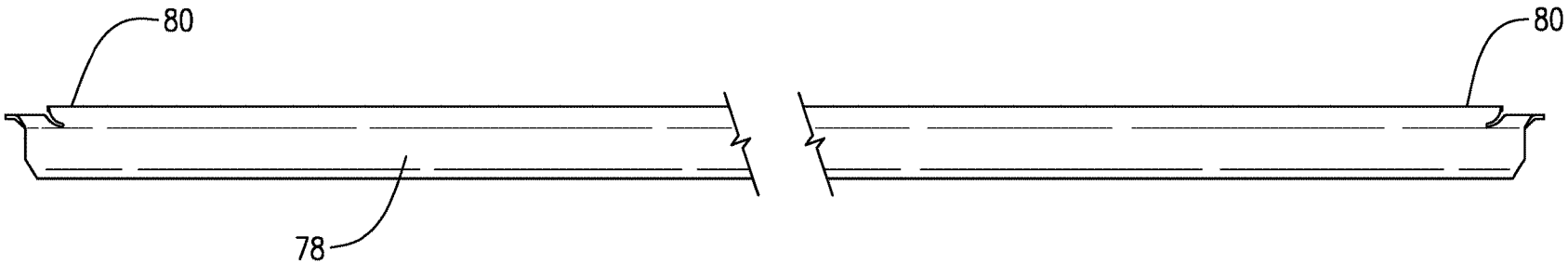
FIG. 13 is a top plan view of the rail shown in FIG. 11, taken along line 13-13.
Figure 14:
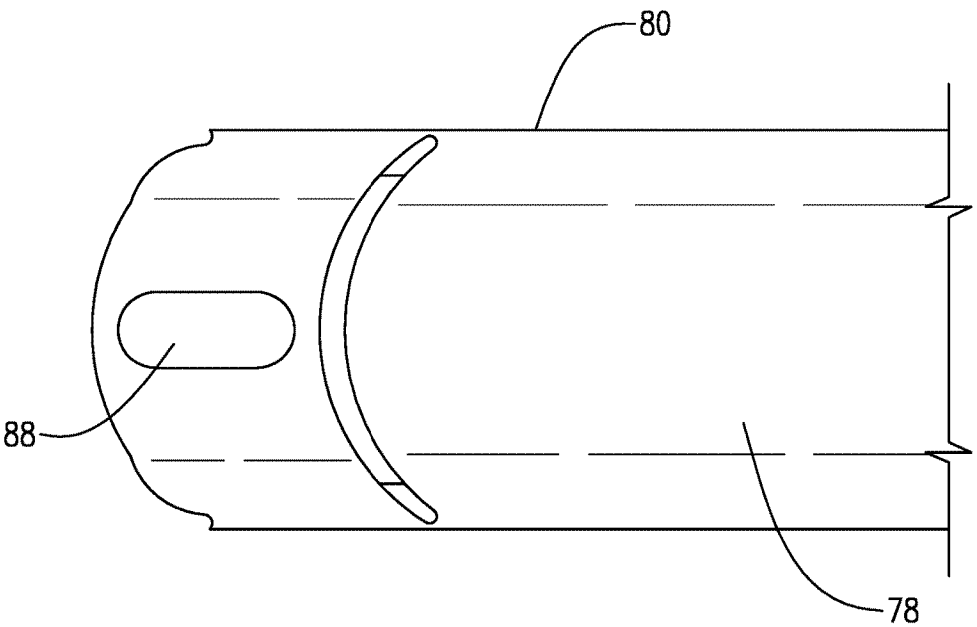
FIG. 14 is an enlarged front elevation view of an end portion of the rail shown in FIG. 11.
Figure 15:
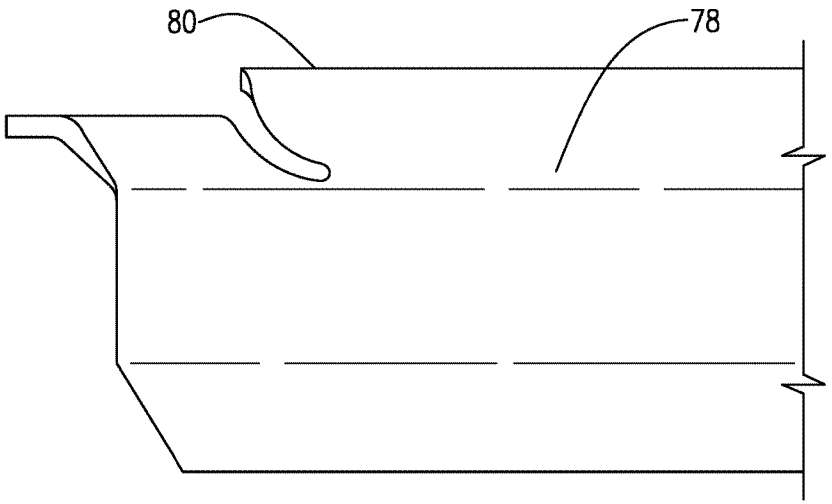
FIG. 15 is a top plan view of the end portion of the rail shown in FIG. 14.

The post 14 is shown in detail in FIGS. 8-10. The post 14 is an elongate structure, preferably of uniform cross-sectional shape, having an upper end 64 and an opposed lower end 66. The post 14 features a flat and elongate web 68 having a pair of laterally spaced edges. A flat and elongate flange joins each lateral edge of the web 68, and extends in orthogonal relationship to the web 68. The pair of opposed flanges, designated as forward flange 70 and rearward flange 72, cooperate with the web 68 to form the I-shaped cross-sectional shape shown in FIG. 9. Preferably the post 14 has maximum cross-sectional dimensions that are less than those of the bollard 12.

The web 68 and flanges 70 and 72 preferably comprise regions of the same single piece of material. Each flange is separated from the adjacent web 68 by a fold in the material. Each of the flanges 70 and 72 is characterized by a substantially flat double-wall structure, while the flat web 68 is a single-walled structure. The double walls of the flanges are preferably formed by folding planar portions of material into an overlapping and abutting configuration.

As shown in FIG. 8, a series of longitudinally-spaced pairs of panel attachment openings 74 are formed in the forward flange 70, beginning nearest the upper end 64. Preferably, respective members of each pair of openings 74 overlie opposite sides of the web 68, and are situated at equal distance from the upper end 64. The number of pairs of openings 74 should equal the number of secondary rails 40 in each panel 44 forming the secondary structure 32. In the embodiment shown in the Figures, each panel includes three such rails, so the number of pairs of openings 74 is three, for a total of six panel attachment openings 74.

The panel attachment openings 74 preferably have identical sizes and shapes. More preferably, the shape of each panel attachment opening 74 is oblong, with its major axis extending orthogonally to the longitudinal axis of the post 14.

As shown in FIG. 10, a series of longitudinally-spaced pairs of plate attachment openings 76 are formed in the rearward flange 72, beginning nearest the upper end 64. Preferably, respective members of each pair of openings 76 overlie opposite sides of the web 68, and are situated at equal distance from the upper end 64. The number of pairs of openings 76 should equal the number of cables 38 in a section 24. In the embodiment shown in the Figures, each section 24 includes three cables 38, so the number of pairs of openings 76 is three, for a total of six plate attachment openings 76.

The plate attachment openings 76 preferably have identical sizes and shapes. More preferably, the shape of each plate attachment opening 76 is oblong, with its major axis extending parallel to the longitudinal axis of the post 14.

Posts suitable for use in the barrier 10 are described in further detail in U.S. Pat. No. 8,382,070, the entire disclosure of which is incorporated by reference.

The posts 14 forming the barrier 10 are preferably of identical size, shape and construction. In the same embodiment described with reference to the bollard 12, each post 14 has a length of 120 inches, a web 68 with a width of 3.88 inches, and flanges 70 and 72 with widths of 2.75 inches. The three pairs of panel attachment openings 74 are respectively situated 3 inches, 15 inches and 72 inches from the upper end 64. The three pairs of plate attachment openings 76 are respectively situated 38.5 inches, 42 inches and 45.5 inches from the upper end 64.

A rail 78, having a structure suitable for use as either a primary rail or a secondary rail, is shown in detail in FIGS. 11-15. Each rail 78 is an elongate channel-shaped member having a pair of opposed end portions 80. A rail channel 82, sized to receive one or more cables, runs the length of the rail 78. The elongate opening 84 of the channel 82 in each rail 78 is situated opposite an elongate flat section 86. A fastener opening 88 is formed at each end portion 80 of the rail 78.

Further detail about the rail 78, and how it is assembled with a post 14, is provided in the aforementioned U.S. Pat. No. 8,382,070.

Preferably, the rails serving as primary rails 36 are of identical size, shape and construction. Likewise, the rails serving as secondary rails 40 are of identical size, shape and construction. The primary and secondary rails 36 and 40 are preferably identical as well, with two exceptions.

First, a primary rail 36 preferably has a somewhat shorter length than a secondary rail 40. Second, a secondary rail 40 may be provided with a series of longitudinally-spaced fastener openings in the flat section 86, for attachment of pickets 42, while such openings need not be provided in a primary rail 36.

In the same embodiment described with reference to the bollard 12 and post 14, each of the primary rails is a rail 78 with a length of 92.56 inches, a maximum height of 2.11 inches and a maximum width of 2.11 inches. Each of the secondary rails is a rail 78 with a length of 95 inches, a maximum height of 2.11 inches and a maximum width of 2.11 inches.

A picket 42 is shown in FIG. 3, and another in FIG. 4. Each picket 42 is supported by the secondary rails 40 forming the secondary structure 32. A plurality of fasteners are used to secure each picket 42 to its supporting secondary rails 40. Suitable pickets for use in the barrier 10 are described in U.S. Pat. No. 6,874,767, the entire disclosure of which is incorporated by reference. Further detail about how the picket 34 is assembled with a rail 78 is provided in the aforementioned U.S. Pat. No. 8,382,070.

The pickets 42 forming the barrier 10 are preferably of identical size, shape and construction. In the same embodiment described with reference to the bollards 12 and posts 14, the picket 42 has a length of 94 inches and an overall width of 2.75 inches. The center-to center separation distance between adjacent pickets 34 installed on a secondary rail 40 is preferably 6 inches.

Figure 16:
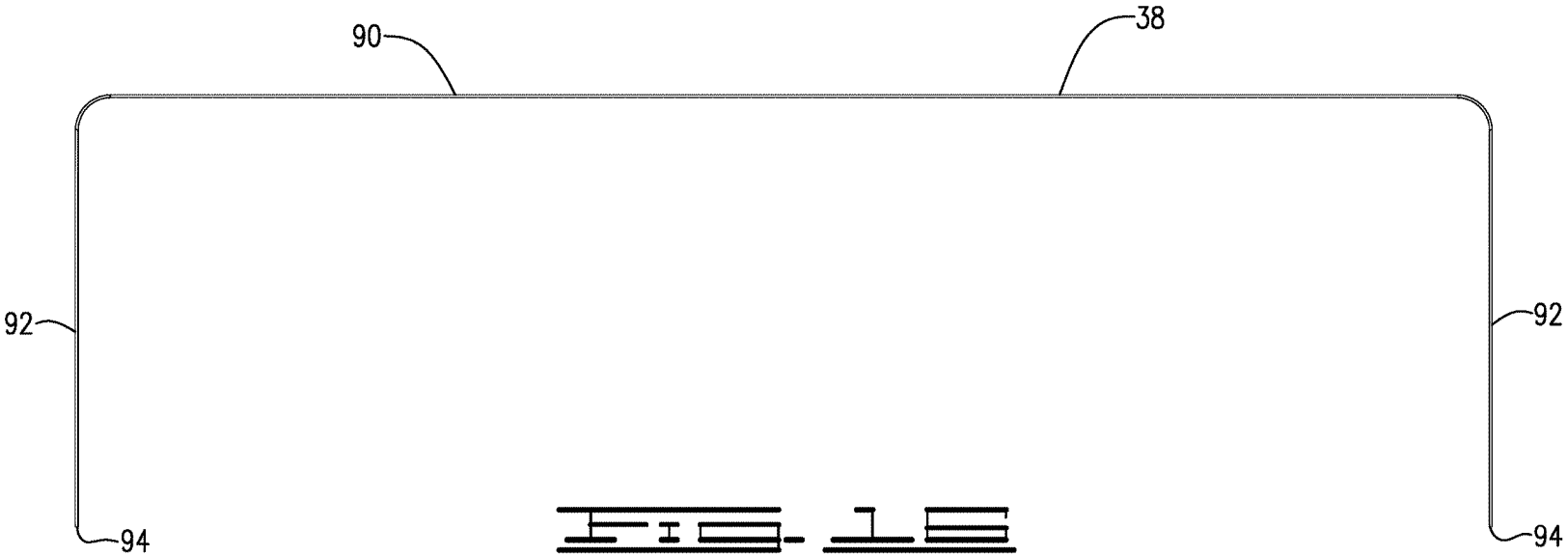
FIG. 16 is a semi-schematic view of a strengthening cable.

The strengthening cable 38, shown in FIG. 16, is an elongate and flexible structure having a medial portion 90 that joins opposed end portions 92. Each end portion 92 terminates in a free end 94. The cable shown in the Figure has been bent to the configuration it will eventually assume in a section 24 of the barrier 10, with a medial portion 90 extending horizontally, and end portions 92 extending vertically. When a section 24 of the barrier 10 is fully assembled, the medial portion 90 will be contained within a run 34 of primary rails 36, and each end portion 92 will be contained within a bollard 12.

The cable 38 is preferably a structural strand satisfying ASTM standard A586, and more preferably is galvanized. Such structural strand can permit lesser cable diameters than would be possible with a corresponding wire rope product, although at a cost of greater cable stiffness.

The cables 38 forming the barrier 10 are preferably of identical size, shape and construction. In the same embodiment described with reference to the bollards 12 and posts 14, each cable 38 has a diameter of 0.75 inches and a length of 51 feet, 4 inches.

Figure 17:
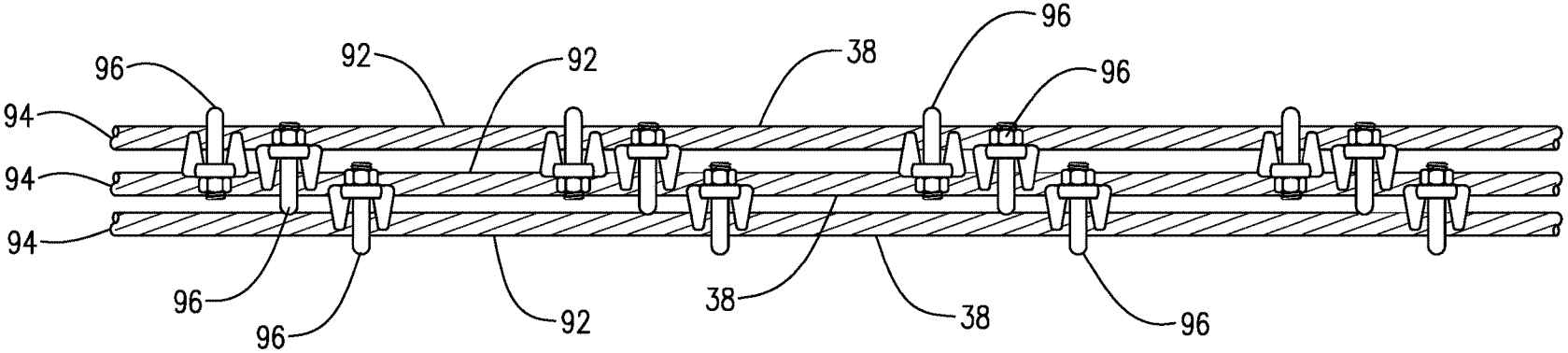
FIG. 17 shows the end portions of three of the cables shown in FIG. 16, each with plural cable clips attached.
Figure 18:
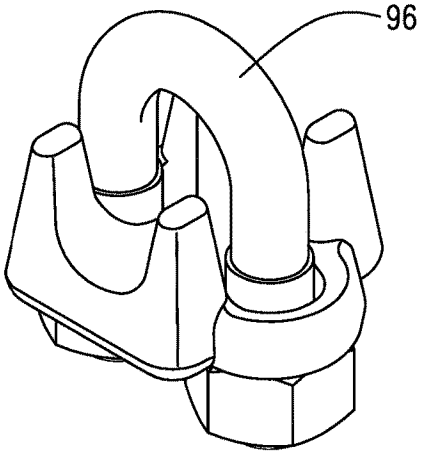
FIG. 18 is an enlarged perspective view of a cable clip.
Figure 13:
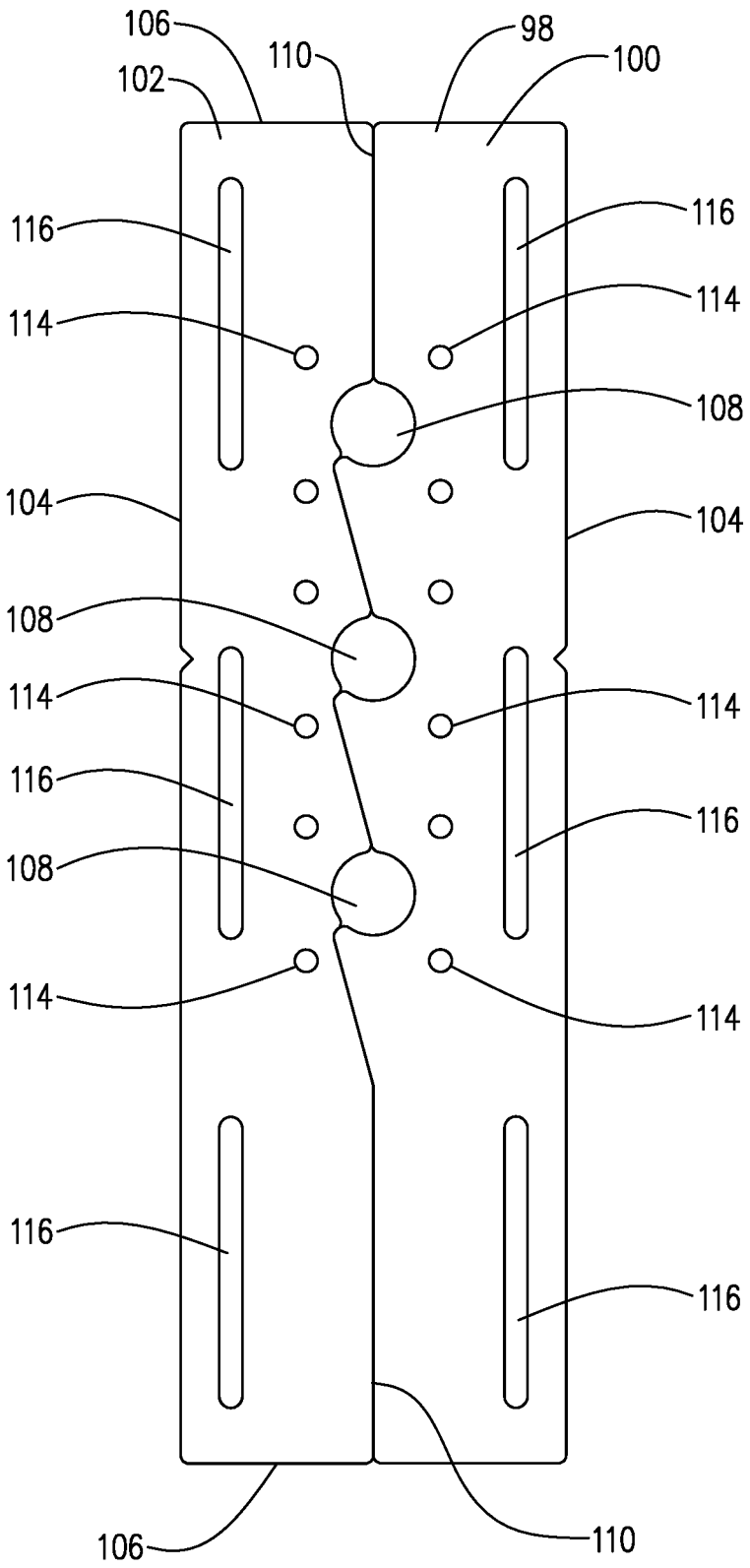

A plurality of cable clips 96, shown in FIGS. 17 and 18, are preferably installed on each end portion 92 of each cable 38 forming the barrier 10. The installed cable clips 96 are longitudinally spaced from each other, and from the end 94 which they adjoin. Preferably, the spacing of the cable clips 96 at each end portion 92 is uniform. The cable clips 96 increase the effective cross-sectional shape of the cable 38, and enhance the cable's resistance to pullout upon an impact to the barrier 10.

In the embodiment shown in the Figures, four cable clips 96 are installed on each end portion 92 of each cable 38. Each pair of adjacent clips 96 is spaced by about 1 foot. When a group of cable end portions 92 is to be bundled for installation into the same bollard 12, the longitudinal positions of clips 96 in the respective cables is preferably staggered, as shown in FIG. 17, in order to facilitate installation through the cable entry port 58. To further facilitate such installation in the circumstance when three or more cables are to be installed in a bollard 12, the clip 96 on at least one cable 38 is also preferably inverted in relation to its counterpart clips 96 on the other cables 38, as shown in FIG. 17.

The cable clips 96 forming the barrier 10 are preferably of identical size, shape and construction. A cable clip suitable for forming the barrier 10 is the Crosby G-450 forged wire rope clip, manufactured by The Crosby Group LLC, of Tulsa, Oklahoma. In the same embodiment described with reference to the cable 38, the clip 96 is sized to fit a cable size of 0.75 inches. The general structure of an acceptable clip is described and shown in U.S. Pat. No. 388,840. Each cable entry port 58 is preferably sized to receive the end portions 92 of a plurality of cables 38, while those end portions 92 are in a laterally-offset relationship. More preferably, the plurality of cables 38 have a number equaling the number of cables 38 included in a section 24 of the barrier 10.

When the end portions 92 of the cables 38 include attached cable clips 96, each cable entry port 58 is preferably sized to receive therethrough, not just the end portions 92 but the attached clips 96 as well, while the end portions 92 are in a laterally-offset relationship. More preferably, the plurality of cables 38 have a number equaling the number of cables 38 included in a section 24 of the barrier 10.

Figure 20:
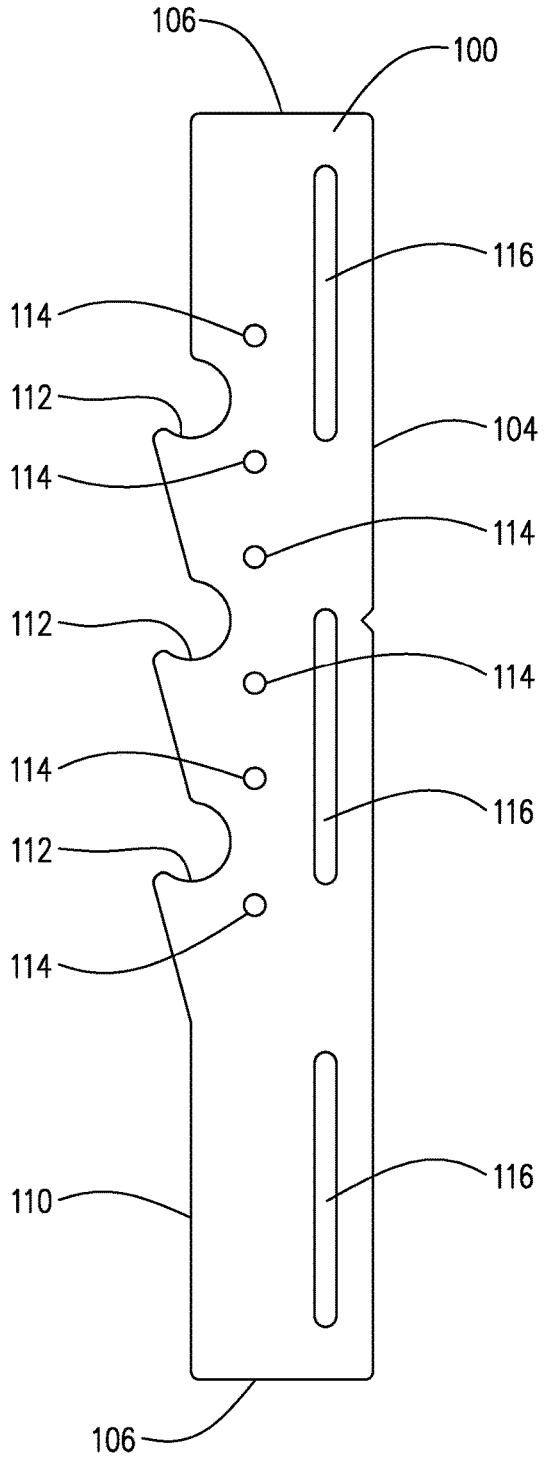
FIG. 20 is a front elevation view of the first part of the closure shown in FIG. 19.
Figure 21:
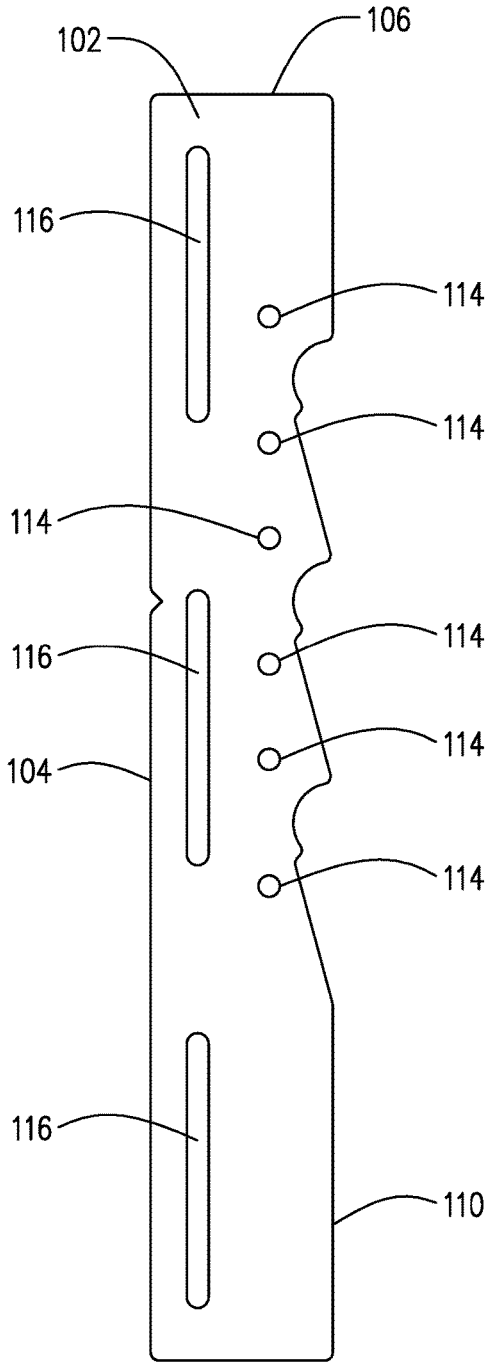
FIG. 21 is a front elevation view of the second part of the closure shown in FIG. 19.

A closure 98, shown in FIG. 19, covers the cable entry port 58 of a bollard 12. Each closure 98 is formed from multiple interlocking parts, preferably two in number. The first part 100 is shown in FIG. 20, and the second part 102 is shown in FIG. 21. The closures 98 forming the barrier 10 are preferably of identical size, shape and construction.

The assembled closure 98 is a flat structure that is sized to fully cover the cable entry port 58 of a bollard 12. Each closure 98 preferably has a non-square rectangular shape bounded by parallel major external edges 104 and parallel minor external edges 106. The major external edges 104 preferably extend in parallel relationship to the longitudinal axis 46 of the bollard 12.

At least one, and preferably a plurality of cable openings 108 are formed within in the closure 98, away from the external edges 104 and 106. Each cable opening 108 is sized and shaped to closely but clearingly receive a single cable 38. Preferably, each cable opening 108 is circular in shape. The number of cable openings 108 should equal the number of cables 38 in a section 24 of the barrier 10. In the embodiment shown in the Figures, there are three such cables 38 in a section 24, so the number of cable openings 108 in the closure 98 should be three as well.

When the closure 98 is provided with plural cable openings 108, those openings should be aligned along a line that parallels the major external edges 104 of the closure 98. The spacing between adjacent cable openings 108 should match the desired vertical spacing between cables 38 in a section 24 of the barrier 10.

The closure 98 is broken into first and second parts 100 and 102 by an internal edge 110, which extends between the minor external edges 106 and intersects each of the cable openings 108. Preferably, the first part 100 includes a plurality of concave cable support segments 112, equal in number to the number of cable openings 108. Each cable support segment 112 constitutes a major portion of the periphery of a corresponding cable opening 108.

A plurality of bracket attachment openings 114 are formed in the closure 98, and surround each of the cable openings 108. In the embodiment shown in the Figures, the number of bracket attachment openings 114 that surround each cable opening 108 is four.

At least one, and preferably of plurality of pairs of elongate adjustment slots 116 are formed in the closure 98, away from the external edges 104 and 106. One member of each pair of adjustment slots 116 is situated adjacent each major external edge 104. The paired adjustment slots 116 are preferably of identical size and shape, and are situated at equal distances from the same minor external edge 106. When plural pairs of adjustment slots 116 are provided, the adjustment slots 116 adjacent each major external edge 104 are longitudinally spaced and collinear. In the embodiment shown in the Figures, the number of pairs of adjustment slots 116 is three, for a total of six adjustment slots 116.

The closures 98 forming the barrier 10 are preferably of identical size, shape and construction. In the same embodiment described with reference to the bollards 12 and posts 14, the closure 98 has a rectangular shape with a major side of 20 inches and a minor side of 6.35 inches. The cable openings 108 are circular, and have a diameter of 1.25 inches. Adjacent cable openings 108 are spaced by a center-to center separation distance of 3.5 inches.

Figure 22:
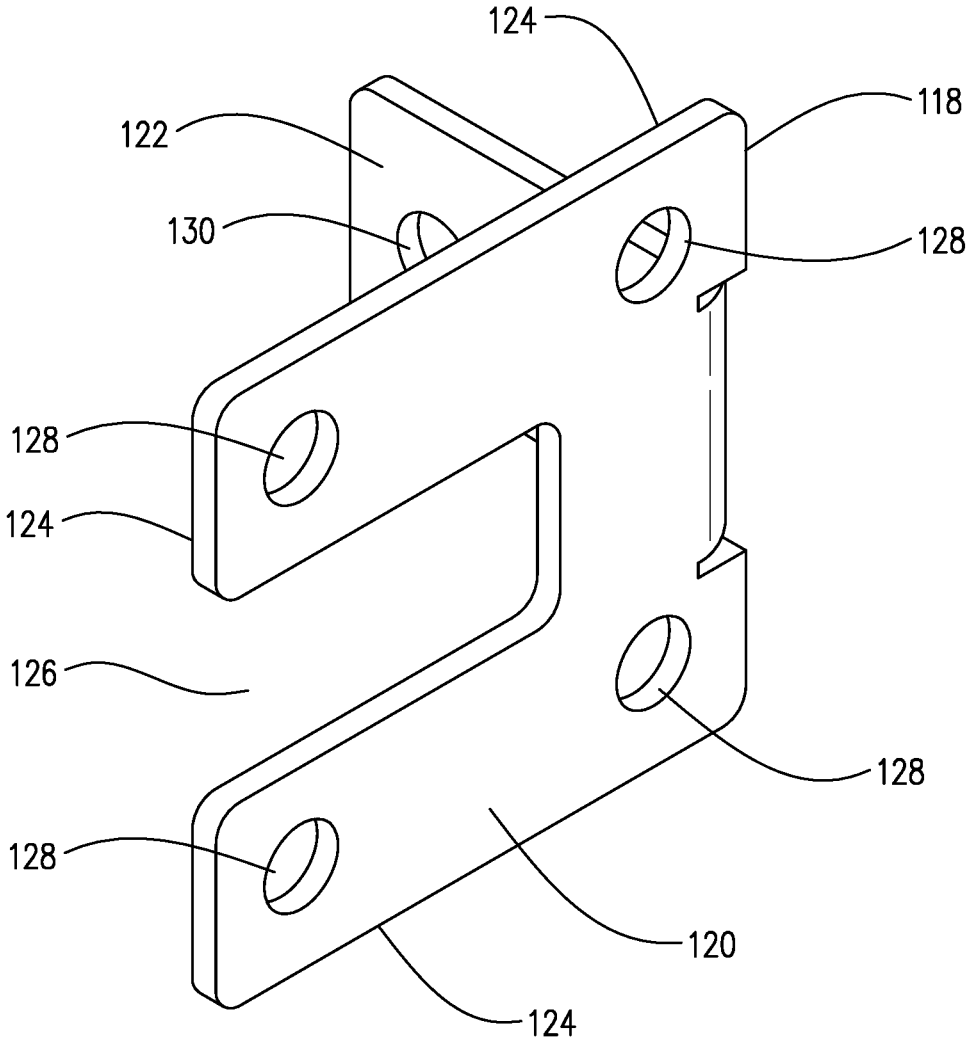
FIG. 22 is a perspective view of a rail attachment bracket.
Figure 23:
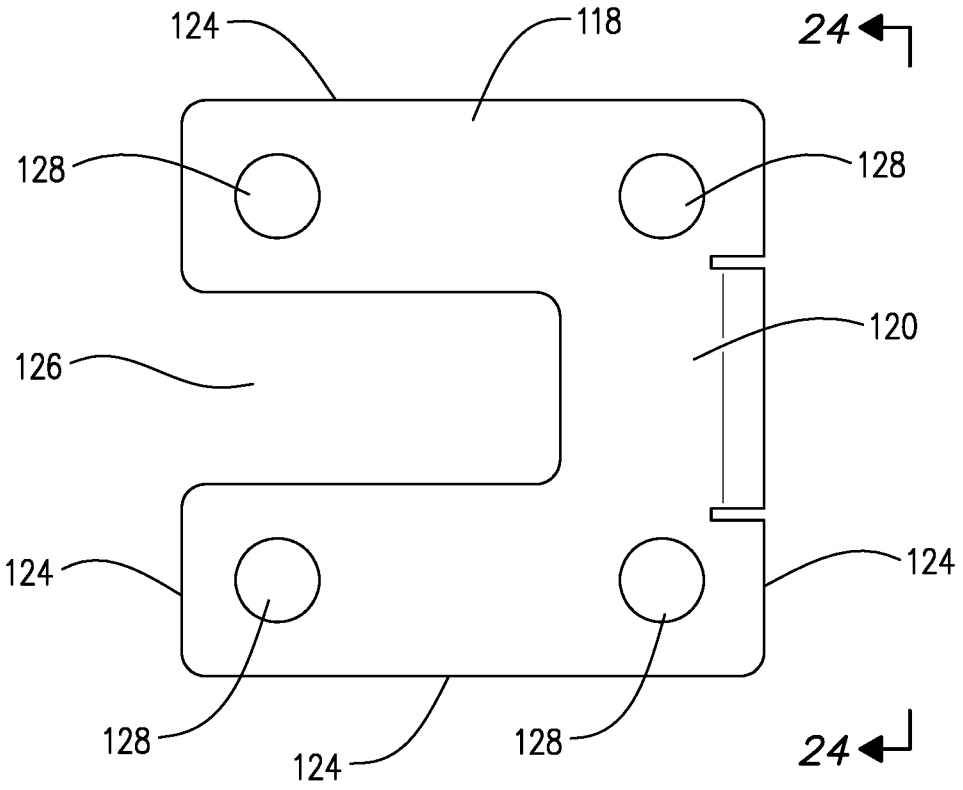
FIG. 23 is a front elevation view of the rail attachment bracket shown in FIG. 22.
Figure 24:
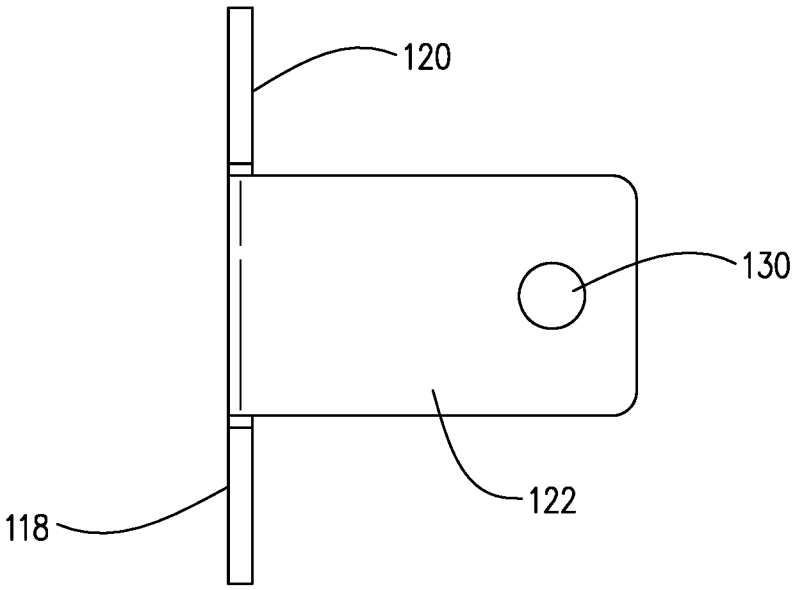
FIG. 24 is a side elevation view of the rail attachment bracket shown in FIG. 23, taken along line 24-24.

A rail attachment bracket 118, shown in FIGS. 22-24, comprises a flat base 120 that is joined to a flat projecting tab 122. The base 120 and tab 122 are disposed in orthogonal relationship. The base 120 is preferably of generally rectangular shape, and is bounded by four sides 124. A channel 126, shaped and sized to clearingly receive a cable 38, is formed in one of the sides 124. A plurality of bollard attachment openings 128 is formed in the base 120. The bollard attachment openings 128 are arranged in a pattern that registers with the pattern of bracket attachment openings 114 formed in the closure 98. A rail attachment opening 130 is formed in the tab 122.

The rail attachment brackets 118 forming the barrier 10 are preferably of identical size, shape and construction. In the same embodiment described with reference to the bollards 12 and posts 14, the rail attachment bracket 118 has a square base 120 with sides 124 of 3.03 inches, and a rectangular tab 122 with a major side of 2.13 inches and a minor side of 1.25 inches. The channel 126 is 1 inch wide and 1.97 inches deep.

Figure 25:
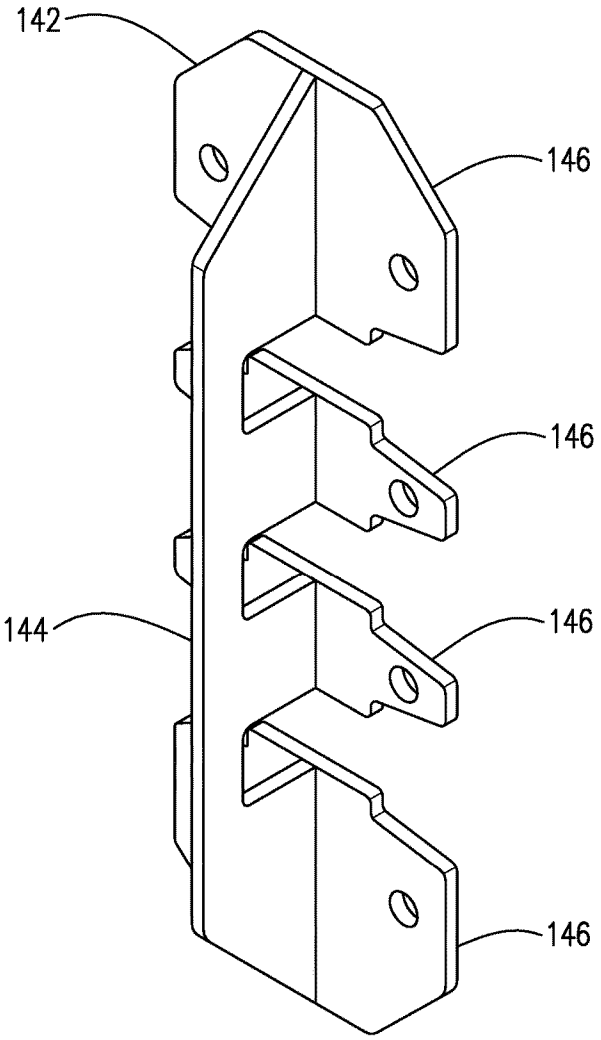
FIG. 25 is a front elevation view of a post plate.

A post plate 132, shown in FIG. 25, is a flat and elongate structure having a pair of parallel major edges 134. Various openings are formed in the post plate 132, including rail attachment openings 136, bracket attachment openings 138 and post attachment openings 140.

Pairs of rail attachment openings 136 are preferably formed near the major edges 134 of the post plate 132, with one member of each pair situated adjacent each major edge 134. The pairs are provided in a number that equals the number of cables 38 in a section 24 of the barrier 10. In the embodiment shown in the Figures, there are three cables 38, so the number of pairs of rail attachment openings 136 is three, for a total of six rail attachment openings 136. The rail attachment openings 136 preferably have identical sizes and shapes. The separation distance between adjacent pairs of rail attachment openings 136 should equal the separation distance between adjacent primary rails 36 in the primary structure 30.

Pairs of bracket attachment openings 138 are likewise preferably formed near the major edges 134 of the post plate 132, with one member of each pair situated adjacent each major edge 134. In the embodiment shown in the Figures, the bracket attachment openings 138 are six in number, and are arranged in two parallel lines. The bracket attachment openings 138 preferably have identical sizes and shapes.

The post attachment openings 140 are preferably situated inside the array of rail attachment openings 136 and bracket attachment openings 138, and are provided in a number that matches the number of plate attachment openings 76. The post attachment openings 140 are arranged in a pattern that registers with that of the plate attachment openings 76. The post attachment openings 140 preferably have identical sizes and shapes. Optionally, one of the holes 140 may be smaller than the others, for purposes of grounding.

The post plates 132 forming the barrier 10 are preferably of identical size, shape and construction. In the same embodiment described with reference to the bollards 12 and posts 14, the post plate 132 has a hexagonal shape with a length of 17.5 inches and a maximum width of 5.88 inches. Other shapes for the post plate, such as an hourglass, are possible.

Figure 26:
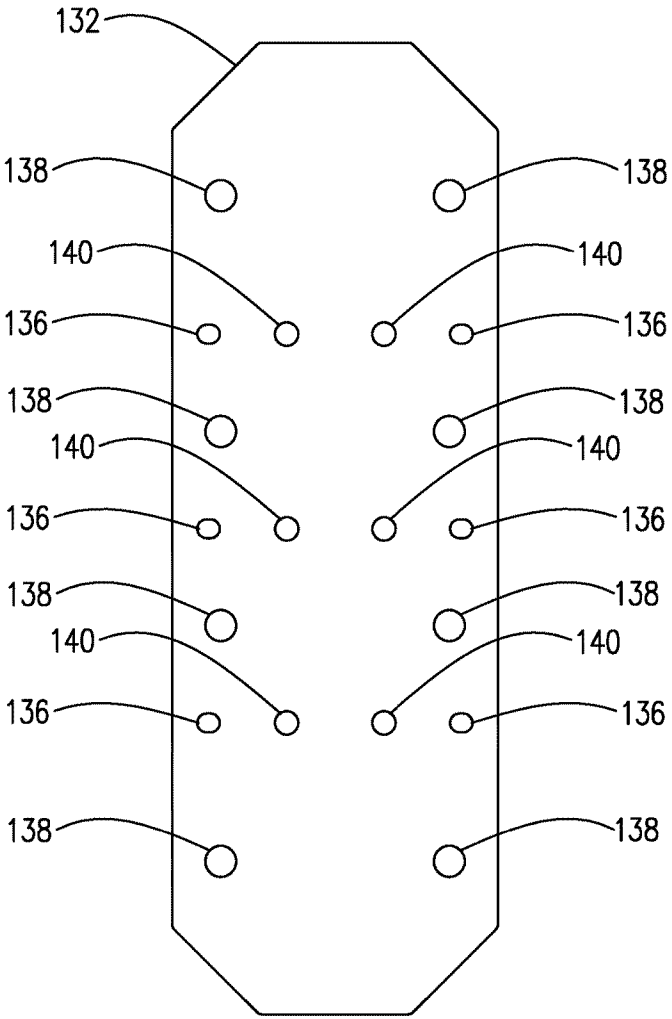
FIG. 26 is a perspective view of a cable confinement bracket.
Figure 26:
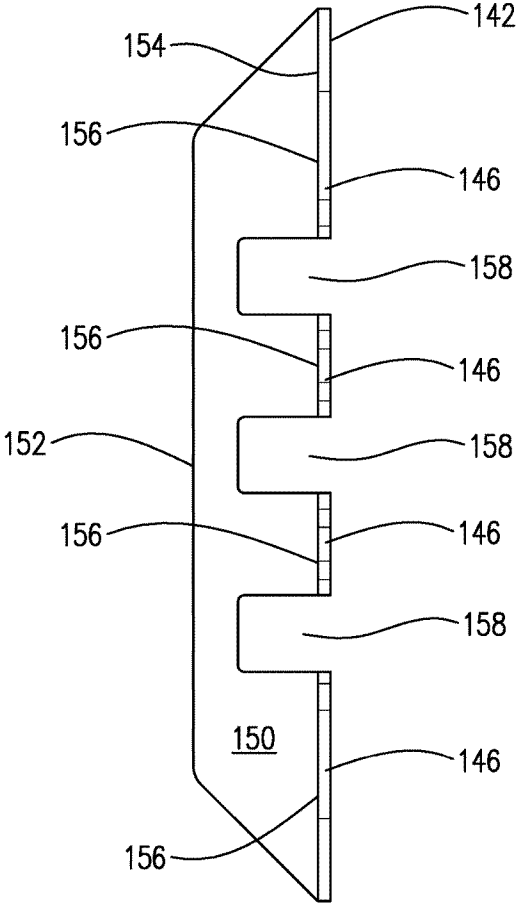
Figure 27:
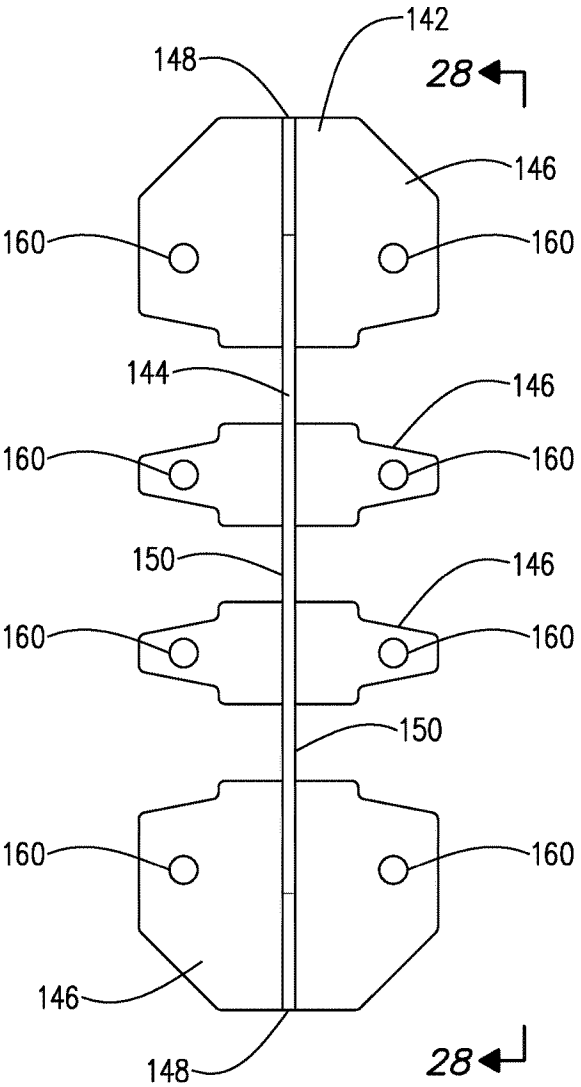
FIG. 27 is a front elevation view of the cable confinement bracket shown in FIG. 26.

A cable confinement bracket 142, shown in FIGS. 26-28, comprises a flat and elongate spine 144 and a plurality of longitudinally-spaced feet 146. The spine 144 is characterized by opposed ends 148 and a pair of opposed sides 150. The ends 148 are joined by an upper edge 152 and a lower edge 154. Preferably, the edges 152 and 154 converge, without necessarily joining, adjacent each of the ends 148.

The lower edge 154 is made up of a plurality of longitudinally-spaced rectilinear segments 156 disposed in collinear relationship. Interspersed between the segments 156 are a series of longitudinally-spaced bays 158, with one bay 158 situated between each adjacent pair of segments 156.

Preferably, the bays 158 have identical sizes and shapes. Each bay 158 is sized to receive a cable 38 therethrough. The bays 158 are provided in a number that equals the number of cables 38 in a section 24 of the barrier 10. In the embodiment shown in the Figures, there are three such cables 38, so the number of bays 158 is three. Preferably, no bays are formed in the upper edge 152.

The feet 146 join the lower edge 154 of the spine 144 at the segments 156, preferably such that a one-to-one relationship exists between feet 146 and segments 156. Preferably, each foot 146 is flat and extends on both sides of the spine 144, in orthogonal relationship to the spine 144.

A pair of plate attachment openings 160 are formed in each foot 146, with one situated on each side of the spine 144. Preferably, the plate attachment openings 160 are of identical size and shape. The pattern of plate attachment openings 160 should register with the pattern of bracket attachment openings 138 in the post plate 132.

The cable confinement brackets 142 forming the barrier 10 are preferably of identical size, shape and construction. In the same embodiment described with reference to the bollards 12 and posts 14, the cable confinement bracket 142 has a length of 17.5 inches, a height of 2.69 inches, and a maximum width of 5.88 inches. Each of the bays 158 has a rectangular shape with dimensions of 1.5 inches by 1.56 inches. Adjacent bays 158 have a center-to-center separation distance of 3.5 inches.

Figure 29:
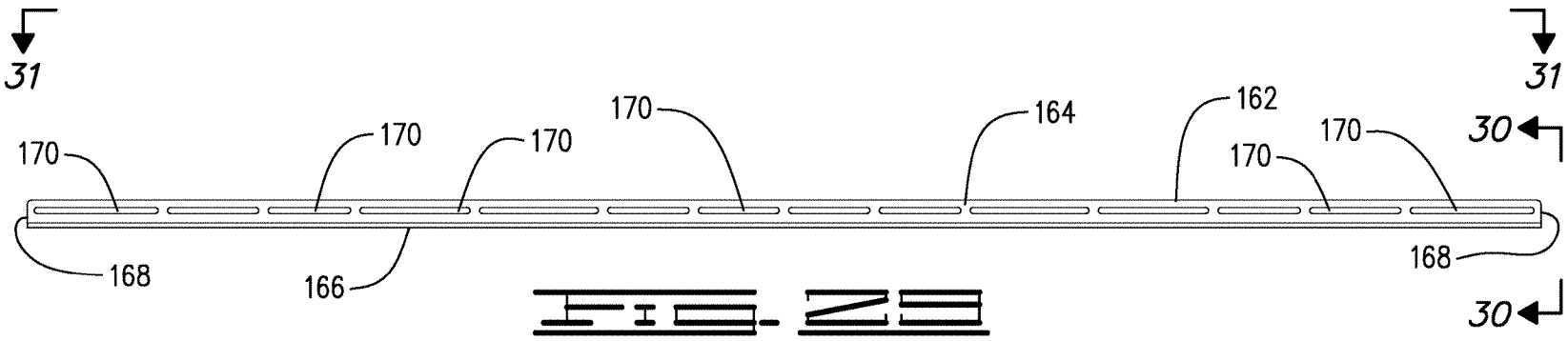
FIG. 29 is a front elevation view of a panel attachment bracket.
Figure 30:
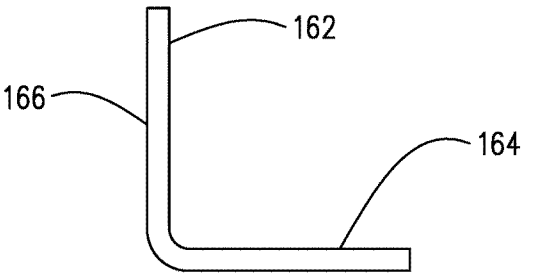
FIG. 30 is a side elevation view of the panel attachment bracket shown in FIG. 29, taken along line 30-30.
Figure 31:
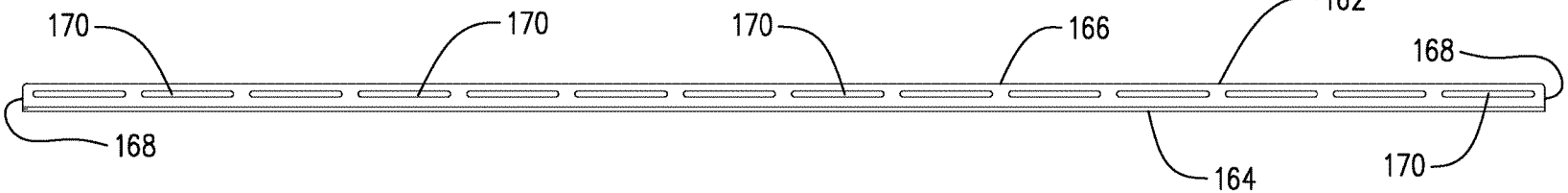
FIG. 31 is a top plan view of the panel attachment bracket shown in FIG. 29, taken along line 31-31.
Figure 22:
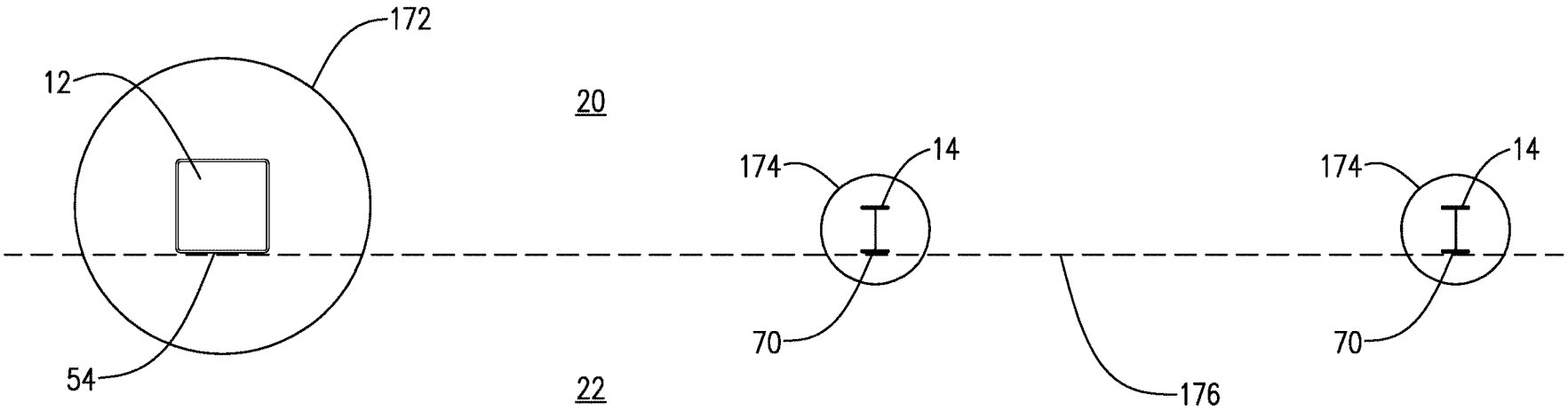

A panel attachment bracket 162, shown in FIGS. 29-31, is an elongate structure formed from a first leg 164 and a second leg 166. Each of the legs 164 and 166 is flat, and has opposed ends 168. The legs 164 and 166 are joined at a shared longitudinal edge, and are disposed in orthogonal relationship. A series of longitudinally-spaced slots 170 is formed in each of the legs 164 and 166, in spaced relationship to the ends 168.

The panel attachment brackets 162 forming the barrier 10 are preferably of identical size, shape and construction. In the same embodiment described with reference to the bollards 12 and posts 14, each panel attachment bracket 162 is 82.5 inches in length, and each of the legs 164 and 166 is 1.5 inches wide. Each slot is between 4 and 5 inches in length, with a separation distance of about 1 inch between adjacent pairs of slots 170. The slots 170 come no closer to each of the ends 168 than between about 0.5 and 1.0 inches.

Components of the barrier 10, including bollards 12, posts 14, pickets 42, rails 78, closures 98, rail attachment brackets 118, post plates 132, cable confinement brackets 142 and panel attachment brackets 162, are preferably formed from a strong and durable material, such as steel. To enhance its resistance to corrosion, that steel is preferably galvanized. After forming of a component is complete, a polyester powder coating is preferably applied, in order to further enhance its resistance to corrosion.

Assembly of the barrier 10 begins by arranging the bollards 12 and posts 14 that will form the spine 18, and embedding them into the terrain 16. Steps at this stage may be carried out for the bollards 12 and posts 14 of a single section 24, or for those of multiple sections 24.

Preferably, each of the bollard 12 and posts 14 is embedded into a corresponding underground footing, which is preferably formed from a ballast material such as concrete. Each bollard 12 and post 14 preferably extends to the base of the footing into which it is embedded.

More preferably, each bollard 12 is embedded into a footing 172, and each post 14 is embedded into a footing 174, as shown in FIGS. 1-4. The footings 172, which are preferably identical to one another, are also preferably larger and more massive, and extend more deeply, than the footings 174. Also preferably, each of the footings 172 is reinforced by a rebar cage. The footings 174 are likewise preferably identical to one another.

A bollard 12 or post 14 is embedded into a footing preferably by first digging an appropriately-sized hole in the terrain 16. The bollard or post is lowered into the hole, lower end first, and oriented vertically. If the footing is to contain any reinforcing structure, such as rebar, that structure is placed in the hole as well. Unused space within the hole is then filled with a fluid filler material, such as 4,000 psi concrete. The filler material is allowed to harden, thereby forming the footing.

Preferably, the bollards 12 are set in their respective footings 172 during an initial stage of assembly of the barrier 10. Optionally, setting of a bollard 12 into a footing 172 may be postponed until the that bollard is to be filled with ballast material, in which case the two steps proceed concurrently.

In the same embodiment described with reference to the bollards 12 and posts 14, each footing 172 is a concrete cylinder with a depth of 7 feet and a diameter of 3 feet. Each footing 174 is a concrete cylinder with a depth of 3 feet and a diameter of 1 foot. When installed in its footing 172, each bollard 12 has an above-ground height of 7 feet, 3 inches. When installed in its footing 174, each post 14 has an above-ground height of 7 feet. The middle plate attachment openings 76 are situated 42 inches above the terrain 16.

Preferably, an adjacent pair of bollards 12 forming the barrier 10 are separated by a distance equal to the length of the cable 38, less the lengths of the two cable end portions 92 that will reside within the bollards 12. In the same embodiment described with reference to the bollards 12 and posts 14, in which the cable 38 has a length of 51 feet, 4 inches, the center-to-center separation distance between adjacent bollards 12 is 32 feet, 10 inches.

At least one, and preferably a plurality of posts 14 are situated between each adjacent pair of bollards 12 forming the barrier 10. In the embodiment shown in the Figures, the number of posts 14 between each adjacent pair of bollards 12 is three.

In the same embodiment described with reference to the bollards 12 and posts 14, the center-to-center separation distance between adjacent posts 14 is 96 inches. In the same embodiment, for those posts 14 situated nearest to a bollard 12 on one side, the center-to-center bollard-post separation distance is 101 inches.

In each section 24 of the barrier 10 in which the spine 18 is rectilinear, the bollards 12 and posts 14 should be collinear, as shown in FIG. 32. The posts 14 should be arranged so that their forward flanges 70 face the unprotected zone 22. Each bollard 12 should be arranged such that one of its front sides 54 faces the unprotected zone 22, and one of its cable entry sides 56 faces in the direction that the cable 38 will extend. The front side 54 of the bollard 12 and the forward flanges 70 of the post 14 should extend within the same single plane 176. The cable entry sides 56 of the end bollards 26 should face one another.

In a subsequent stage of assembly, the primary structure 30 of the barrier 10 is attached to the spine 18. Although it is preferred to first attach the primary structure 30 and to thereafter attach the secondary structure 32, this order of installation may be reversed. Further, installation steps relating to the secondary structure 32 may be interspersed with, or proceed concurrently with, steps relating to the primary structure 30.

Figure 33:
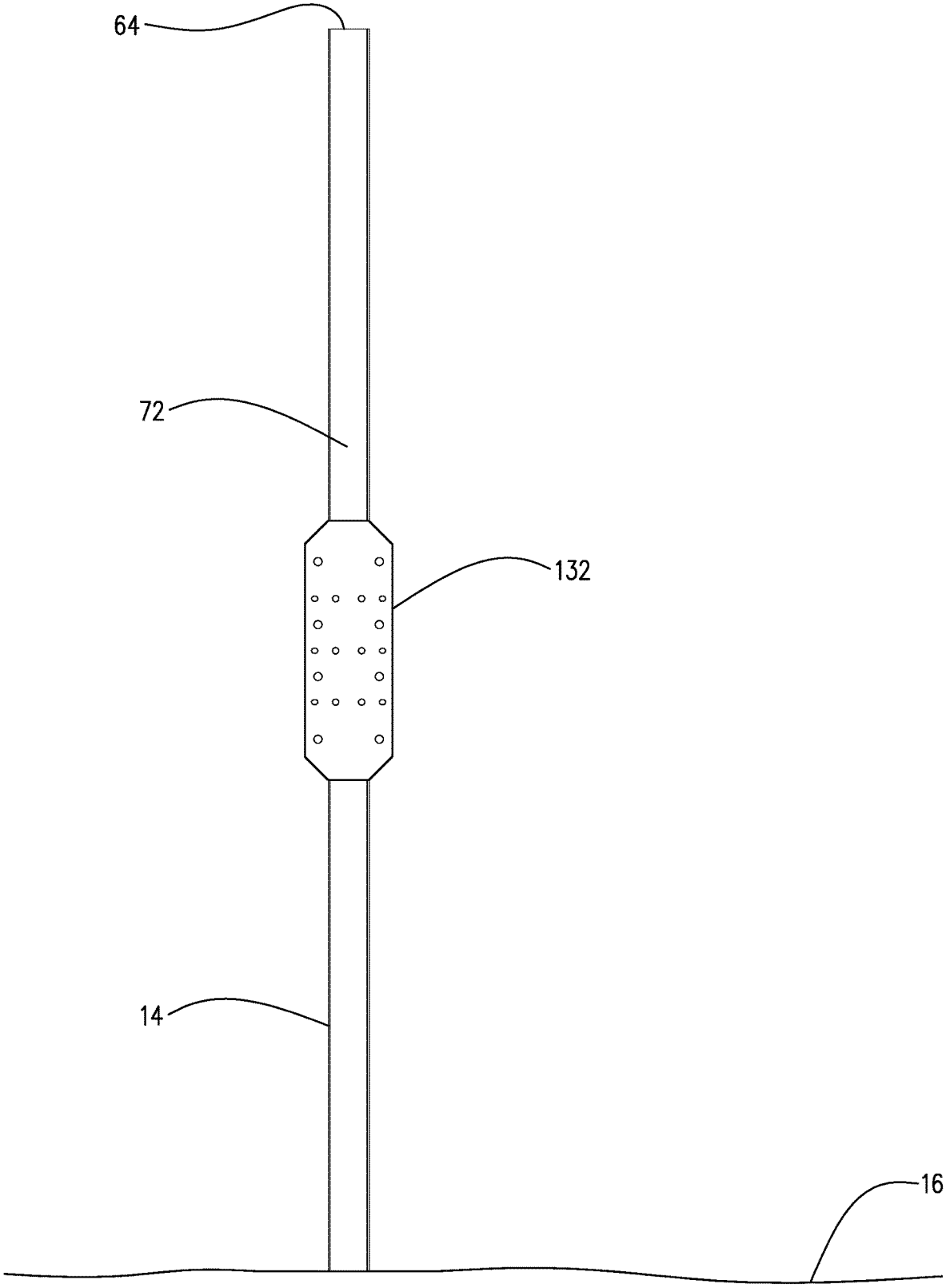
FIG. 33 shows a stage of assembly of the barrier. A post plate has been installed on the rearward flange of the post shown in FIG. 10.

At an initial stage of assembly of the primary structure 30, post plates 132 are installed on the rearward flanges 72 of posts 14. Steps at this stage may be carried out for the posts 14 of a single section 24, or for posts 14 in multiple sections 24. To install a post plate 132, the post attachment openings 140 are aligned with the plate attachment openings 76. Fasteners are inserted through the aligned openings and actuated to complete the attachment. The resulting structure is shown in FIG. 33. These steps are repeated for each post 14 in a section 24 under assembly.

Figure 34:
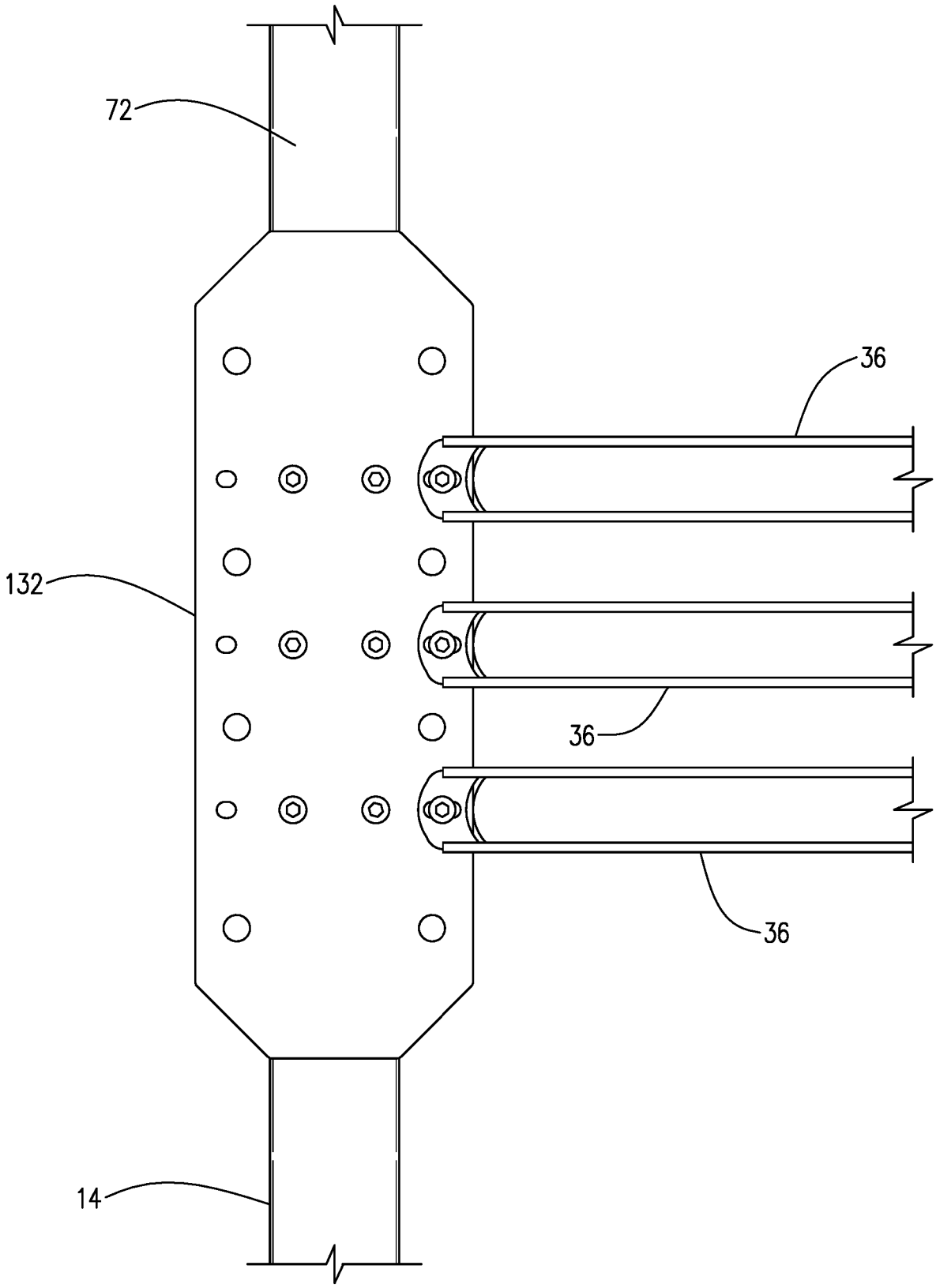
FIG. 34 shows assembly of the barrier at a stage subsequent to that shown in FIG. 33. Primary rails have been attached at the post plate shown in FIG. 33.

At a subsequent stage of assembly of the primary structure 30, primary rails 36 are installed between adjacent pairs of posts 14. A primary rail 36 is first arranged so that its opening 84 faces toward the protected zone 20. Each end portion 80 of the primary rail 36 is positioned in overlying relationship to the post plate 132 of a corresponding post 14. The fastener opening 88 is aligned with a rail attachment opening 136, chosen so that the primary rail 36 extends substantially horizontally. Fasteners are inserted through the aligned openings and actuated to complete the attachment. The resulting structure is shown in FIG. 34. These steps are repeated for each primary rail 36 in a section 24 under assembly.

Installation of those primary rails 36 that interconnect a post 14 with a bollard 12 are preferably postponed to a later stage of assembly, to be described hereafter.

In a subsequent stage of assembly of the primary structure 30, cables 38 are bundled together and installed into bollards 12. Steps at this stage may be carried out for the bollards 12 and cables 38 of a single section 24, or for the bollards 12 and cables 38 of multiple sections 24.

If not done previously, clips 96 are installed at each end of each cable 38 that will form a section 24, as shown and described with reference to FIG. 17. The cables 38 are laid out, preferably on the terrain 16, such that their opposite ends 94 are positioned adjacent the bollards 12 in which they are to be installed. FIG. 17 shows how the end portions 92 of the cables 38, with attached clips 96, are to be arrayed adjacent each bollard 12.

The end portions 92 of the cables 38 are next temporarily bundled together with a pair of ligatures. These ligatures are preferably applied to the cables 38 on opposite sides of the plurality of clips 96, and may be formed from adhesive tape or flexible cord. The bundled end portions 92 are next inserted into the cable entry port 58 of the adjacent bollard 12. After each ligature of the bundle enters the bollard 12, that ligature may, but need not, be released, as by cutting. Once inside a bollard 12, the cables 38 are pushed until their ends 94 are situated adjacent the lower end 50.

Figure 35:
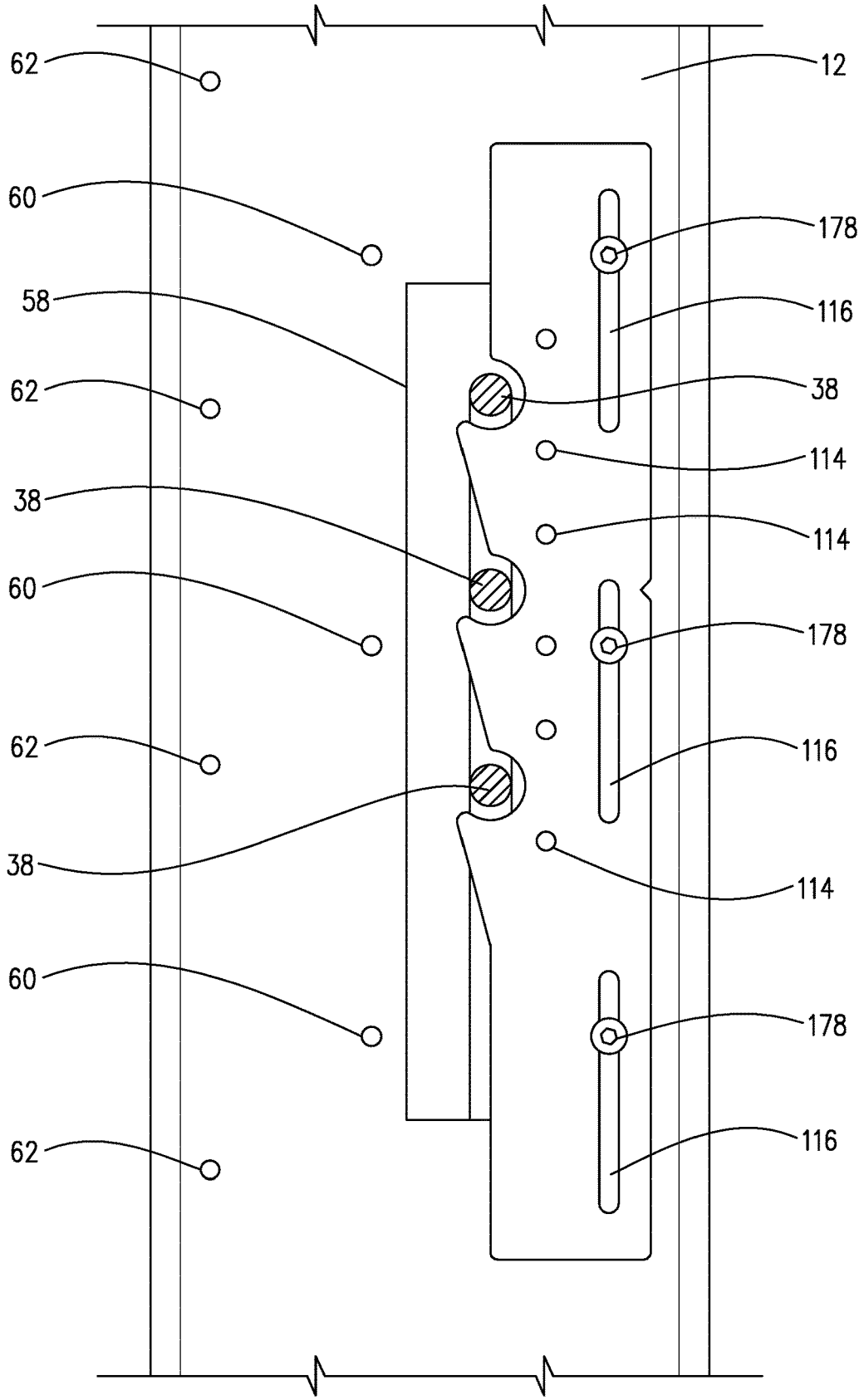
FIG. 35 a side elevational view of a portion of the bollard of FIG. 6, showing another stage of barrier assembly. Bundled strengthening cables, shown in cross-section, have been inserted endwise into the cable entry port of the bollard shown in FIG. 6, and the first piece of the closure installed on the bollard.
Figure 3B:
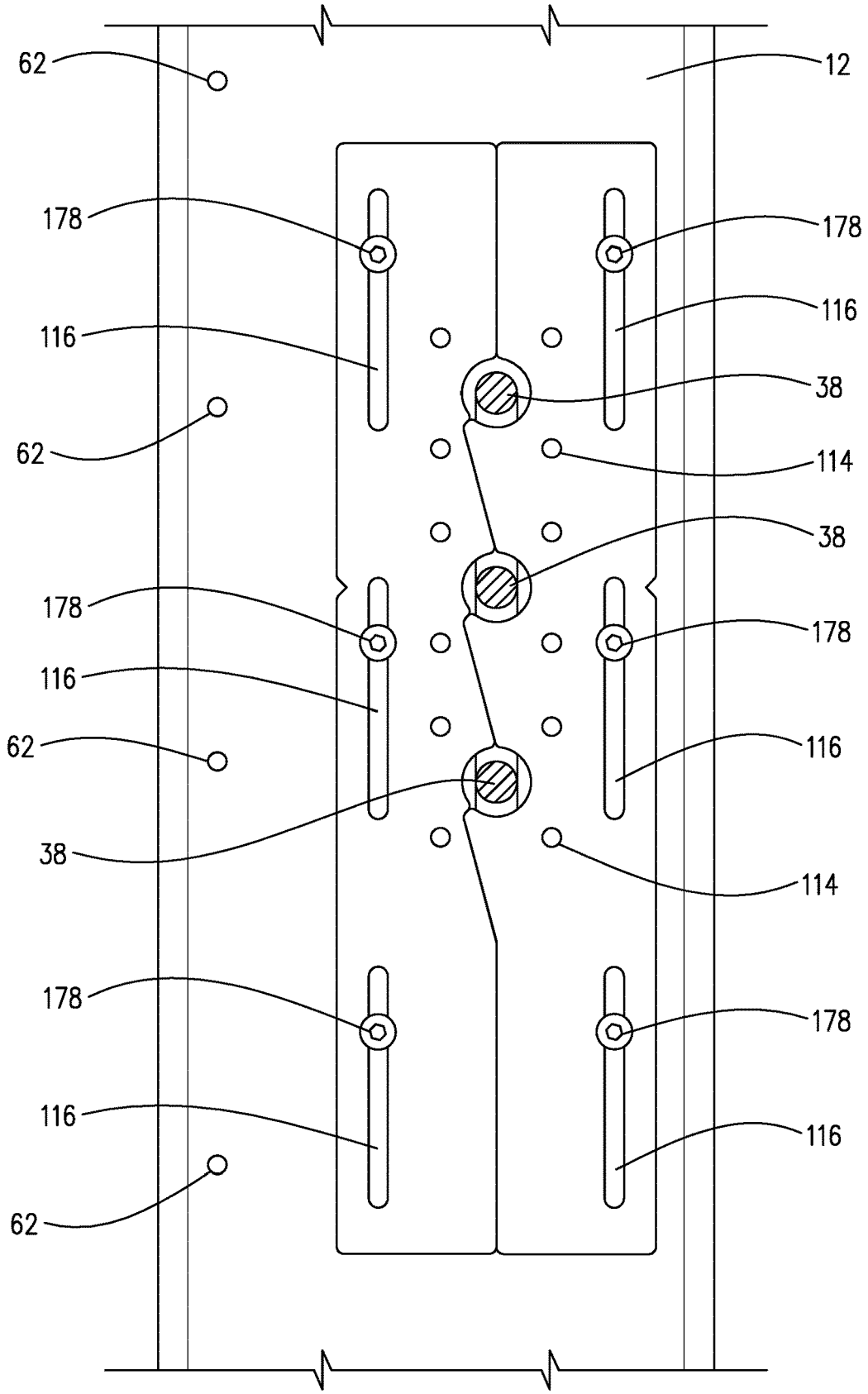

The first part 100 of the closure 98 is next positioned on the cable entry side 56 of a bollard 12, in partially overlying relationship to the cable entry port 58. Each of the cables 38 exiting the bollard 12 is rested on a corresponding one of the cable support segments 112. Slots 116 in the first part 100 are aligned with closure attachment openings 60 in the bollard 12, fasteners 178 are inserted into the aligned openings, and the fasteners 178 actuated to attach the first part 100 to the bollard 12. The resulting structure is shown in FIG. 35.

The second part 102 of the closure 98 is next positioned on the cable entry side 56 of the bollard 12, and assembled with the first part 100 to form a complete closure 98. Each of the cables 38 now exits the bollard 12 through a corresponding one of the cable openings 108. Slots 116 in the second part 102 are aligned with closure attachment openings 60 in the bollard 12, fasteners 178 are inserted into the aligned openings, and the fasteners 178 actuated to attach the second part 102 to the bollard 12. The cable entry port 58 is now fully closed by the closure 98. The resulting structure is shown in FIG. 36.

During assembly of the bollard 12 as just described, the closure 98 should be positioned so that each cable opening 108 is situated at an above-ground height that equals the desired height of the horizontal run 34 of the cable 38 in the section 24. The elongate shape of the adjustment slots 116 affords significant freedom in vertical positioning of the closure 98, and thereby relieves any need for the kind of extreme precision that might otherwise be required in placement of the bollards 12.

The foregoing steps are repeated for each bollard 12 in a section 24 under assembly. In the same embodiment described with reference to the bollards 12 and posts 14, the above-ground heights of the cable openings 108 are 38.5 inches, 42 inches, and 45.5 inches.

In a subsequent stage of assembly of the primary structure 30, rail attachment brackets 118 are installed on bollards 12. Steps at this stage may be carried out for the bollards 12 of a single section 24, or for the bollards 12 of multiple sections 24.

Each rail attachment bracket 118 is configured to join an end portion 80 of one of the primary rails 36 to one of the closures 98. A rail attachment bracket 118 is installed by positioning its base 120 against an installed closure 98, adjacent a cable opening 108. Optionally, an elastomeric gasket 180, shown in FIG. 37 and having the same general shape and configuration as the base 120, may be sandwiched between the base 120 and the closure 98.

Bollard attachment openings 128 in the rail attachment bracket 118 are aligned with bracket attachment openings 114 in the closure 98 (and corresponding openings in the gasket 180, if any). Fasteners are inserted through the aligned openings, and the fasteners actuated to form an attachment. These steps are repeated for each cable opening 108 in the closure 98, and for each bollard 12 in a section 24 under assembly.

Once a rail attachment bracket 118 is attached to a closure 98 adjacent a cable opening 108, the exiting cable 38 passes through the channel 126 of the rail attachment bracket 118.

If a gasket 180 underlies the rail attachment bracket 118, a slit underlying the channel 126 permits the cable 38 to pass through the gasket 180.

In a subsequent stage of assembly of the primary structure 30, primary rails 36 are installed between bollards 12 and adjoining posts 14. Steps at this stage may be carried out for the primary rails 36, bollards 12 and posts 14 of a single section 24, or for those of multiple sections 24.

Figure 37:
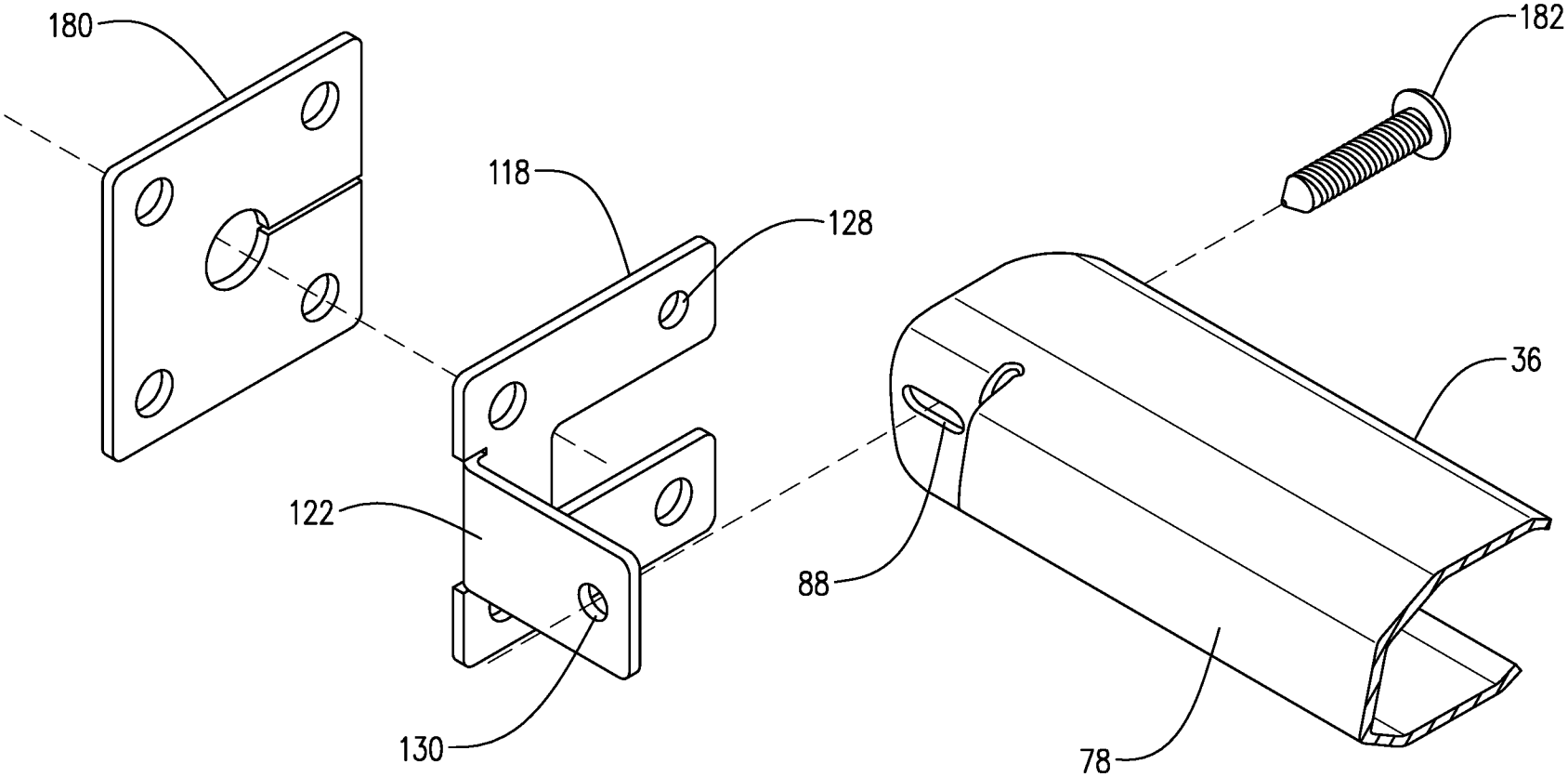
FIG. 37 is a perspective exploded view showing the mode of assembly of a gasket, the rail attachment bracket, and a rail.
Figure 3B:
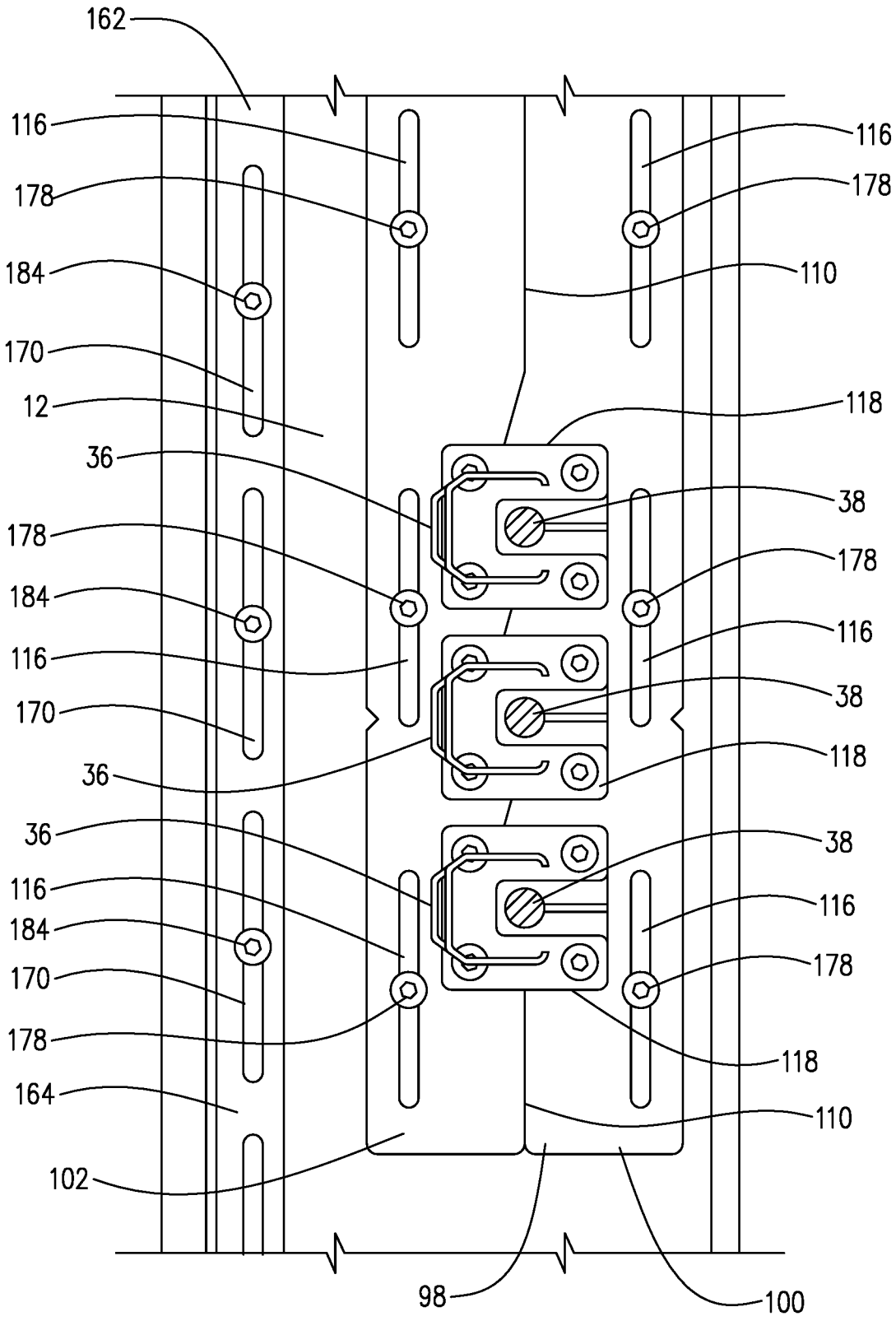
Figure 33:
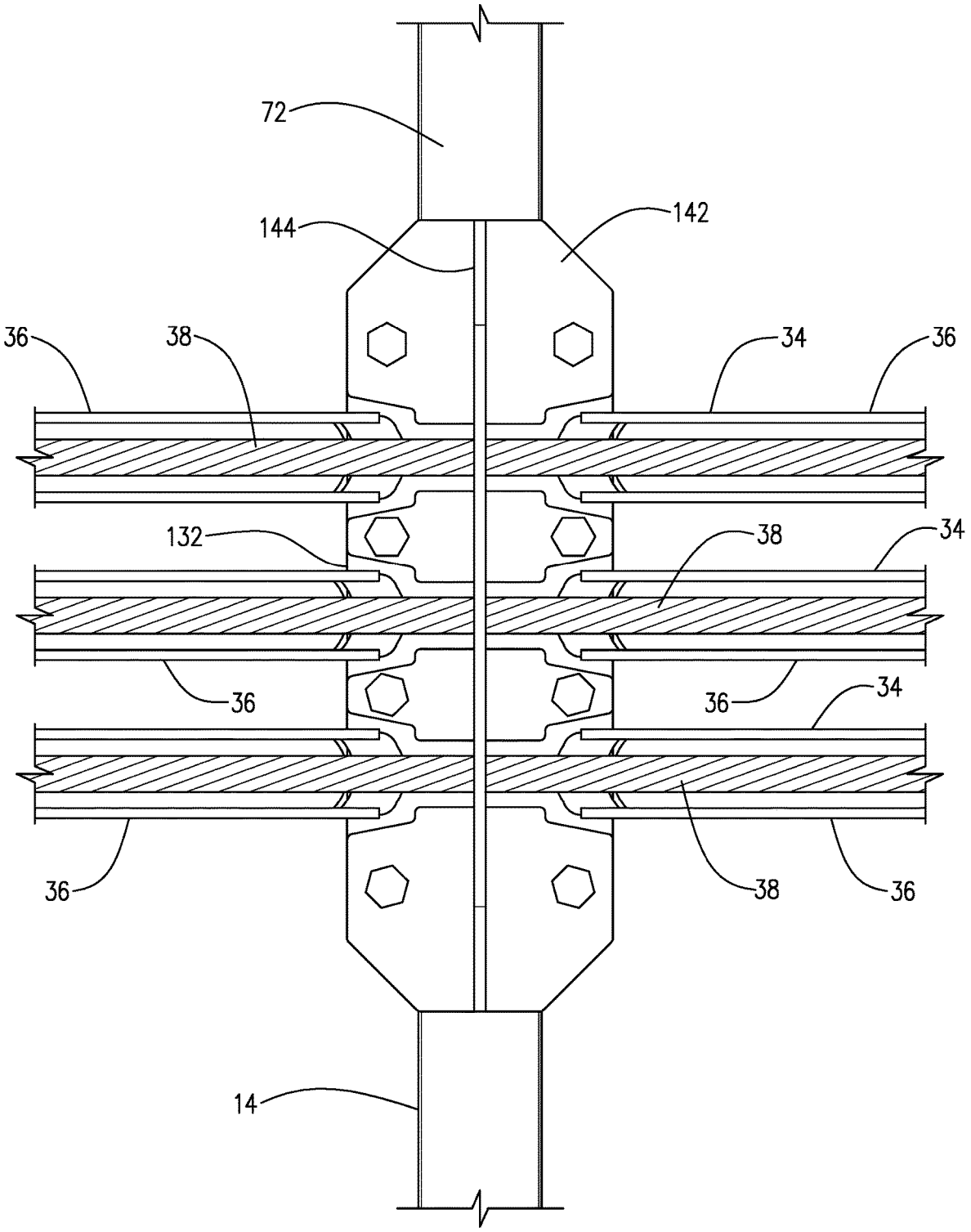

The mode of joining a primary rail 36 to a bollard 12 is shown in FIG. 37. The fastener opening 88 at the end portion 80 of a primary rail 36 is aligned with a rail attachment opening 130 in the tab 122 of a rail attachment bracket 118. A fastener 182 is inserted through the aligned openings, and the fastener 182 actuated to secure the primary rail 36 to the rail attachment bracket 118, which is turn secured to the bollard 12. Installation of the other end of the primary rail 36 to a neighboring post 14 follows the same steps described with reference to FIG. 34. The foregoing steps are repeated for each primary rail 36 that will join a bollard 12, and for each bollard 12 in a section 24 under assembly.

With all of the primary rails 36 of a section 24 installed, each of the cables 38 is inserted into a corresponding one of the runs 34 of primary rail 36 in that section 24. Insertion occurs at the openings 84 of the primary rails 36. The resulting structure, viewed at bollard 12, is shown in FIG. 38. While a panel attachment bracket 162 is shown as installed in FIG. 38, the installation can be postponed until a subsequent stage of the assembly process.

In a subsequent stage of assembly of the primary structure 30, each bollard 12 is filled from its upper end 48 with a ballast material, such as 4,000 psi concrete. If concrete is chosen as the ballast material, it is preferably poured into the bollard 12 as a fluid filler material and then allowed to harden, in the same manner described with reference to the footings 172 and 174. Ballast material should fill a bollard 12 above the level of the contained cables 38, and above the level of the cable entry port 58.

Steps at this stage may be carried out for the bollards 12 of a single section 24, or for bollards 12 of multiple sections 24. If a bollard 12 is to receive additional cables 38 from an adjoining section 24, the filling step should be postponed until all such cables 38 have been received inside the bollard 12.

In a subsequent stage of assembly of the primary structure 30, and after each cable 38 has been installed in a run 34, cable confinement brackets 142 are installed on the posts 14. Steps at this stage may be carried out for the posts 14 of a single section 24, or for posts 14 of multiple sections 24.

To install a cable confinement bracket 142, plate attachment openings 160 are aligned with bracket attachment openings 138 in the post plate 132. Fasteners are inserted through the aligned openings and actuated to complete the attachment. The resulting structure is shown in FIG. 39. These steps are repeated for each post 14 in a section 24 under assembly.

The spine 144 of the installed bracket 142 overlies the cables 38, which pass transversely through the bays 158. The cables 38 are blocked from lateral removal at the mouths of the bays 158 by the post 14, via its attached post plate 132. Should the primary structure 30 experience an impact, the spine 144 prevents the cables 38 from flying out of openings 84 in the primary rails 36. The protection afforded by the primary structure 30 is thereby enhanced.

At an initial stage of assembly of the secondary structure 32, a panel attachment bracket 162 is attached to each bollard 12. Steps at this stage may be carried out for the bollards 12 of a single section 24, or for bollards 12 of multiple sections 24.

Figure 40:
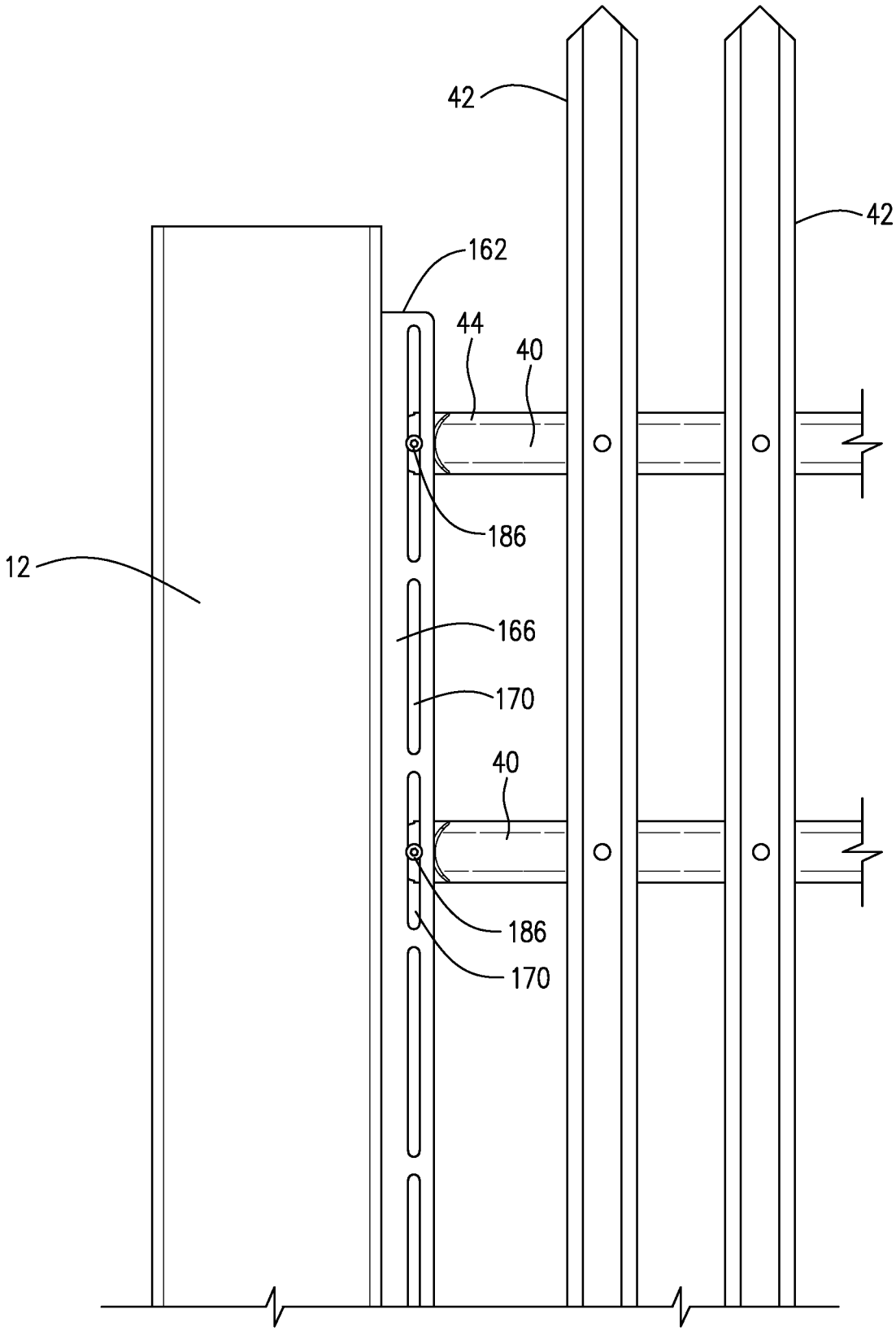
FIG. 40 shows a panel attachment bracket attached to a bollard. A panel is attached to the panel attachment bracket.

To install a panel attachment bracket 162, its first leg 164 is placed flush against the cable entry side 56 of the bollard 12, nearest the unprotected zone 22. The panel attachment bracket 162 should extend parallel to the longitudinal axis 46 of the bollard 12, and its second leg 166 should extend away from the bollard, in coplanar or near-coplanar relationship to the front side 54. The elongate slots 170 in the first leg 164 are aligned with panel attachment openings 62 in the bollard 12. Fasteners 184 are inserted through the aligned openings and actuated to complete the attachment. The resulting structure is shown in FIGS. 38 and 40. These steps are repeated for each bollard 12 in a section 24 under assembly.

In a subsequent stage of assembly of the secondary structure 32, panels 44, comprising a framework of secondary rails 40 and pickets 42, are attached to the spine 18. One such panel 44 is supported between each adjacent pair of posts 14, and between each bollard 12 and any adjacent post 14. The panels 44 may be pre-assembled offsite, or assembled onsite in the course of installation of the barrier 10. Steps at this stage may be carried out for the bollards 12 and posts 14 of a single section 24, or for those of multiple sections 24.

A panel 44, or a secondary rail 40 that will form such a panel 44, is joined to a bollard 12 by orienting a secondary rail 40 such that its opening 84 (shown in FIG. 12) faces toward the protected zone 20. The end of the secondary rail 40 is positioned in underlying relationship to the second leg 166 of the panel attachment bracket 162. The fastener opening 88 of the secondary rail 40 is aligned with a slot 170 in the second leg 166. Fasteners 186 are inserted through the aligned openings and actuated to complete the attachment. The resulting structure is shown in FIG. 40. These steps are repeated at the bollard 12 for each secondary rail 40 that is either in a panel 44 and or will form such a panel 44.

A panel 44, or a secondary rail 40 that will form such a panel 44, is joined to a post 14 by similar steps, with the forward flange 70 of the post 14 replacing the second leg 166 of the panel attachment bracket 162, and a panel attachment opening 74 replacing the slot 170. These steps are repeated at the post 14 for each secondary rail 40 that is either in a panel 44 and or will form such a panel 44.

When a panel 44 extends between a bollard 12 and adjacent post 14, or between two adjacent posts 14, each secondary rail 40 should extend substantially horizontally in relationship to the terrain 16, and in parallel relationship to the other secondary rails 40 in the panel 44. The slots 170 and panel attachment openings 74 where the secondary rails 40 are attached should be chosen accordingly.

The foregoing steps are repeated for each bollard 12 and each post 14 in the section 24 under assembly.

A longitudinally-spaced series of parallel pickets 42 are attached to the flat section 86 of each of the secondary rails 40. Preferably, each picket 42 extends vertically, and in orthogonal relationship to the secondary rails 40. The secondary rails 40 and pickets 42 cooperate to form the panel 44. If not part of a preassembled panel 44, the pickets 42 are preferably attached to the secondary rails 40 after those rails have been attached at their ends to their supporting posts 14 and/or bollards 12.

The foregoing steps are repeated until a panel 44 is formed or installed between each bollard 12 and adjacent post 14 of the section 24 under assembly, and between each adjacent pair of posts 14 of the section 24 under assembly.

The foregoing steps are repeated for each section 24 of the barrier 10. The barrier shown in FIGS. 1 and 2 has five such sections.

The barrier 10 may be assembled from a kit. The kit may comprise a plurality of bollards 12 and a plurality of cables 38. The kit may further include a plurality of closures 98. The kit may further include a plurality of cable clips 96.

Another kit may comprise a plurality of bollards 12, a plurality of cables 38, and a plurality of closures 98. The kit may further include a plurality of rails 78 and a plurality of rail attachment brackets 118.

Another kit may comprise a plurality of cable confinement brackets 142, a plurality of cables 38, and a plurality of posts 14.

Another kit may comprise a plurality of bollards 12, a plurality of cables 38, and a plurality of cable clips 96.

Additional components of the barrier 10 described herein, as well as fasteners and other installation hardware, may be included in any of the kits. Components of each of these kits are preferably provided in a number sufficient to form the barrier 10, or a section 24 thereof.

Unless otherwise stated herein, any of the various parts, elements, steps and procedures that have been described should be regarded as optional, rather than as essential. Changes may be made in the construction, operation and arrangement of these parts, elements, steps and procedures without departing from the spirit and scope of the invention as described in the following claims.

The invention claimed is:

1. A system, comprising:

a terrain; and a kit, comprising:

a plurality of elongate cables, each cable having an end portion; and a plurality of elongate and hollow bollards, each bollard having a longitudinal axis, a pair of opposed ends and an elongate axially-extending cable entry port formed intermediate its ends, the cable entry port having a non-square rectangular shape and being sized to receive the end portions of the plurality of cables therethrough while the cables are in a laterally-offset relationship;

in which one of the plurality of bollards is embedded at one of its ends within the terrain, in which the end portion of each of the plurality of cables is situated within the embedded bollard, and in which each of the plurality of cables extends through the cable entry port of the embedded bollard, the cables being in a laterally-offset relationship.

2. The system of claim 1 in which the shape of the cable entry port includes a major side extending parallel to the longitudinal axis of the bollard.

3. The system of claim 1, further comprising:

a plurality of multi-part closures, each closure sized to fully cover the cable entry port and having a plurality of cable openings formed therein, each cable opening being sized to clearingly receive one of the cables therethrough, each closure being broken into parts at an internal edge that intersects each of the cable openings.

4. The system of claim 3 in which each closure is provided with plural closure openings, and in which each bollard is provided with plural closure attachment openings alignable with the plural closure openings of a closure.

5. The system of claim 3 in which each bollard is characterized by an exterior and an interior, and each closure is configured to cover the cable entry port at the bollard exterior.

6. The system of claim 1, further comprising:

a plurality of cable clips, each cable clip attachable to the end portion of one of the cables.

7. The system of claim 6 in which the cable entry port of each bollard is sized to receive the end portions of the plurality of cables therethrough, while each end portion carries one or more attached cable clips and while the cables are in a laterally-offset relationship.

8. The system of claim 1 in which the opposed ends of each bollard are characterized as first and second ends, the cable entry port of each bollard is situated adjacent the first end, and each bollard is configured to be filled with ballast material from the second end to a level above the cable entry port.

9. The system of claim 1 in which each bollard has a polygonal cross-sectional shape.

10. The system of claim 9 in which each bollard has a square cross-sectional shape.

11. A kit, comprising:

a plurality of elongate and hollow bollards, each bollard having a pair of opposed ends and a cable entry port disposed intermediate its ends;

a plurality of elongate cables;

a plurality of multi-part closures, each closure sized to fully cover the cable entry port and having a plurality of cable openings formed therein, each cable opening sized to clearingly receive one of the cables therethrough, each closure being broken into parts at an internal edge that intersects each of the cable openings;

a plurality of elongate rails, each rail having opposed end portions; and a plurality of rail attachment brackets, each rail attachment bracket configured to join an end portion of one of the rails to one of the closures.

12. The kit of claim 11 in which each closure has a non-square rectangular shape.

13. The kit of claim 11 in which each closure is characterized by a pair of opposed external edges and in which a pair of elongate and rectilinear slots are formed in the closure, with one of the slots situated adjacent one of the external edges, and the other slot situated adjacent the other external edge.

14. The kit of claim 13 in which the closure has a non-square rectangular shape and the pair of opposed external edges comprise major sides of the rectangular shape.

15. The kit of claim 14 in which the slots are equidistant from a minor side of the rectangular shape.

16. A system, comprising:

a terrain; and the kit of claim 11, in which one of the plurality of bollards is embedded at one of its ends within the terrain, in which one of the closures fully covers the cable entry port of the embedded bollard, in which each of the plurality of cables has an end portion situated within the embedded bollard, and in which each of the plurality of cables passes through a corresponding one of the cable openings of the covering closure.

17. The kit of claim 11 in which each closure is provided with plural closure openings, and in which each bollard is provided with plural closure attachment openings alignable with the plural closure openings of a closure.

18. The kit of claim 11 in which each closure is bounded in part by a pair of parallel external edges and the internal edge extends between that pair of external edges.

19. The kit of claim 11 in which the closure is elongate, and in which the internal edge traverses the entire length of the closure.

20. The kit of claim 11 in which each bollard is characterized by an exterior and an interior, and each closure is configured to cover the cable entry port at the bollard exterior.

21. A system, comprising:

a terrain; and a kit, comprising:

a plurality of elongate and hollow bollards, each bollard having a longitudinal axis, a pair of opposed ends and a cable entry port formed intermediate its ends;

a plurality of elongate cables, each cable being formed from structural strand and having an end portion; and a plurality of cable clips, each cable clip attachable to the end portion of one of the cables;

in which the cable entry port of each bollard has a non-square rectangular shape and is sized to receive the end portions of at least one of the plurality of cables therethrough, while the said end portion carries at least one attached cable clip; and in which one of the plurality of bollards is embedded at one of its ends within the terrain, in which the end portion of one of the plurality of cables is situated within the embedded bollard, in which at least one of the plurality of cable clips is attached to the said end portion, and in which the said cable extends through the cable entry port of the embedded bollard.

22. A system, comprising:

a terrain; and a kit, comprising:

a plurality of elongate and hollow bollards, each bollard having a pair of opposed ends and a cable entry port disposed intermediate its ends;

a plurality of elongate cables; and a plurality of multi-part closures, each closure sized to fully cover the cable entry port and having a plurality of cable openings formed therein, each cable opening sized to clearingly receive one of the cables therethrough, each closure being broken into parts at an internal edge that intersects each of the cable openings;

in which one of the plurality of bollards is embedded at one of its ends within the terrain, in which one of the closures fully covers the cable entry port of the embedded bollard, in which each of the plurality of cables has an end portion situated within the embedded bollard, and in which each of the plurality of cables passes through a corresponding one of the cable openings of the covering closure.

23. A kit, comprising:

a plurality of elongate and hollow bollards, each bollard having a pair of opposed ends and a cable entry port disposed intermediate its ends;

a plurality of elongate cables; and a plurality of multi-part closures, each closure sized to fully cover the cable entry port and having a plurality of cable openings formed therein, each cable opening sized to clearingly receive one of the cables therethrough, each closure being broken into parts at an internal edge that intersects each of the cable openings, the closure being elongate, and the internal edge traversing the entire length of the closure.

24. A kit, comprising:

a plurality of elongate cables, each cable having an end portion; and a plurality of elongate and hollow bollards, each bollard having a longitudinal axis, a pair of opposed ends and an elongate axially-extending cable entry port formed intermediate its ends, the cable entry port having a non-square rectangular shape and being sized to receive the end portions of the plurality of cables therethrough while the cables are in a laterally-offset relationship;

in which the opposed ends of each bollard are characterized as first and second ends, the cable entry port of each bollard is situated adjacent the first end, and each bollard is configured to be filled with ballast material from the second end to a level above the cable entry port.

25. A kit, comprising:

a plurality of elongate cables, each cable having an end portion; and a plurality of elongate and hollow bollards, each bollard having a polygonal cross-sectional shape, each bollard having a longitudinal axis, a pair of opposed ends and an elongate axially-extending cable entry port formed intermediate its ends, the cable entry port having a non-square rectangular shape and being sized to receive the end portions of the plurality of cables therethrough while the cables are in a laterally-offset relationship.

26. The kit of claim 25 in which each bollard has a square cross-sectional shape.

27. A kit, comprising:

a plurality of elongate cables, each cable having an end portion;

a plurality of elongate and hollow bollards, each bollard characterized by an exterior and an interior and having a longitudinal axis, a pair of opposed ends and an elongate axially-extending cable entry port formed intermediate its ends, the cable entry port having a non-square rectangular shape and being sized to receive the end portions of the plurality of cables therethrough while the cables are in a laterally-offset relationship; and a plurality of multi-part closures, each closure sized to fully cover the cable entry port and having a plurality of cable openings formed therein, each cable opening being sized to clearingly receive one of the cables therethrough, each closure being broken into parts at an internal edge that intersects each of the cable openings and being configured to cover the cable entry port at the bollard exterior.

28. A kit, comprising:

a plurality of elongate and hollow bollards, each bollard characterized by an exterior and an interior and having a pair of opposed ends and a cable entry port disposed intermediate its ends;

a plurality of elongate cables; and a plurality of multi-part closures, each closure sized to fully cover the cable entry port and having a plurality of cable openings formed therein, each cable opening sized to clearingly receive one of the cables therethrough, each closure being broken into parts at an internal edge that intersects each of the cable openings and being configured to cover the cable entry port at the bollard exterior.

* * * * *